US011944257B2

(12) United States Patent
Lee et al.

(10) Patent No.: US 11,944,257 B2
(45) Date of Patent: Apr. 2, 2024

(54) NOZZLE FOR CLEANER

(71) Applicant: LG ELECTRONICS INC., Seoul (KR)

(72) Inventors: Jinwoo Lee, Seoul (KR); Chungjae Ryu, Seoul (KR); Jonghyun Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/877,280

(22) Filed: Jul. 29, 2022

(65) Prior Publication Data

US 2022/0361724 A1 Nov. 17, 2022

Related U.S. Application Data

(63) Continuation of application No. 16/524,759, filed on Jul. 29, 2019, now Pat. No. 11,426,041.

(30) Foreign Application Priority Data

Jul. 30, 2018 (KR) ..... 10-2018-0088842

(51) Int. Cl.
*A47L 9/04* (2006.01)
*A47L 9/28* (2006.01)
(Continued)

(52) U.S. Cl.
CPC ..... *A47L 9/0411* (2013.01); *A47L 9/28* (2013.01); *A47L 11/201* (2013.01); *A47L 11/4083* (2013.01)

(58) Field of Classification Search
CPC .. A47L 11/201; A47L 11/305; A47L 11/4083; A47L 9/0411; A47L 9/0472; A47L 9/28
See application file for complete search history.

(56) References Cited

U.S. PATENT DOCUMENTS 6,237,188 B1 5/2001 Takemoto et al.
6,792,648 B2 9/2004 Lee
(Continued)

FOREIGN PATENT DOCUMENTS

CN 2397880 Y 9/2000
CN 1315602 A 10/2001
(Continued)

OTHER PUBLICATIONS

Chinese Office Action in Chinese Application No. 201980026789.9 dated May 21, 2021 (8 pages).
(Continued)

*Primary Examiner* — Marc Carlson
(74) *Attorney, Agent, or Firm* — Birch, Stewart, Kolasch & Birch, LLP

(57) ABSTRACT

A nozzle for a cleaner has a nozzle housing, which has a nozzle base and a drain hole for discharging water from the nozzle housing. The nozzle also has a rotary cleaning unit disposed below the nozzle housing. The rotary cleaning unit has a rotation plate that can be attached to a mop. The nozzle has a driving unit that includes a driving motor for driving the rotary cleaning unit. The nozzle also has a control board for controlling the drive motor. In addition, the nozzle has a water tank detachably mounted on an upper side of the nozzle housing. The water tank stores water and supplies the water to the rotary cleaning unit.

28 Claims, 26 Drawing Sheets

(51) Int. Cl.

| | |
|---|---|
| ***A47L 11/20*** | (2006.01) |
| ***A47L 11/40*** | (2006.01) |

(56) References Cited

U.S. PATENT DOCUMENTS

| | | | | |
|---|---|---|---|---|
| 6,842,941 | B2 | 1/2005 | Lee | |
| 7,159,276 | B2 | 1/2007 | Omoto et al. | |
| 7,331,082 | B2 | 2/2008 | Hertrick et al. | |
| 7,334,291 | B2 | 2/2008 | Song et al. | |
| 7,640,626 | B2 * | 1/2010 | Oh | A47L 11/4038 15/387 |
| 7,743,462 | B2 * | 6/2010 | Yoo | A47L 9/04 15/375 |
| 8,032,985 | B2 | 10/2011 | Seo | |
| 8,677,552 | B2 | 3/2014 | Krebs | |
| 8,904,595 | B2 | 12/2014 | Davidshofer et al. | |
| 9,265,396 | B1 * | 2/2016 | Lu | B08B 1/001 |
| 9,554,680 | B2 | 1/2017 | Elsdon et al. | |
| 10,123,673 | B2 | 11/2018 | Kim et al. | |
| 10,575,692 | B2 | 3/2020 | Lim et al. | |
| 10,582,826 | B2 | 3/2020 | Hwang et al. | |
| 10,602,902 | B2 | 3/2020 | Ding et al. | |
| 10,638,901 | B2 | 5/2020 | Yang et al. | |
| 10,682,035 | B2 | 8/2020 | Ji et al. | |
| 10,820,764 | B2 | 11/2020 | Krebs | |
| 10,898,045 | B2 | 1/2021 | Woo et al. | |
| 10,952,582 | B2 | 3/2021 | Kim et al. | |
| 10,993,598 | B2 | 5/2021 | Park et al. | |
| 11,006,802 | B2 | 5/2021 | Watanabe et al. | |
| 11,058,278 | B2 * | 7/2021 | Shin | A47L 11/282 |
| 11,096,536 | B2 * | 8/2021 | Yang | A47L 11/4094 |
| 11,154,172 | B2 * | 10/2021 | Kim | A47L 11/4094 |
| 11,191,415 | B2 * | 12/2021 | Yang | A47L 9/0433 |
| 11,730,335 | B1 * | 8/2023 | Resch | A47L 11/4088 15/320 |
| 11,786,093 | B2 * | 10/2023 | Yang | A47L 11/283 134/115 R |
| 2001/0027586 | A1 * | 10/2001 | Lee | A47L 9/0433 15/385 |
| 2002/0112744 | A1 | 8/2002 | Besseling | |
| 2003/0037409 | A1 * | 2/2003 | Lee | A47L 9/0411 15/384 |
| 2003/0221281 | A1 | 12/2003 | Oh | |
| 2004/0163199 | A1 | 8/2004 | Hsu | |
| 2005/0223522 | A1 | 10/2005 | Song et al. | |
| 2007/0067945 | A1 | 3/2007 | Kasper et al. | |
| 2007/0074370 | A1 | 4/2007 | Oh | |
| 2007/0157422 | A1 * | 7/2007 | Oh | A47L 9/0433 15/387 |
| 2008/0282490 | A1 * | 11/2008 | Oh | A47L 9/04 15/246.3 |
| 2009/0064447 | A1 | 3/2009 | Oh et al. | |
| 2009/0229069 | A1 * | 9/2009 | Lenkiewicz | A47L 11/4088 15/320 |
| 2010/0287716 | A1 | 11/2010 | Kasper et al. | |
| 2012/0110775 | A1 | 5/2012 | Krebs | |
| 2013/0121880 | A1 | 5/2013 | Yamazaki | |
| 2015/0113757 | A1 | 4/2015 | Franke et al. | |
| 2015/0128996 | A1 * | 5/2015 | Dooley | A47L 11/4083 15/98 |
| 2015/0272412 | A1 | 10/2015 | Liscio | |
| 2017/0251897 | A1 | 9/2017 | McDowell et al. | |
| 2018/0055313 | A1 | 3/2018 | Yang et al. | |
| 2018/0192846 | A1 | 7/2018 | Ji et al. | |
| 2019/0038106 | A1 * | 2/2019 | Jang | A47L 11/24 |
| 2019/0328193 | A1 | 10/2019 | Yang et al. | |
| 2019/0328194 | A1 | 10/2019 | Kim et al. | |
| 2019/0328196 | A1 | 10/2019 | Kim et al. | |
| 2019/0328201 | A1 | 10/2019 | Shin et al. | |
| 2019/0328202 | A1 | 10/2019 | Yang et al. | |
| 2020/0029762 | A1 * | 1/2020 | Lee | A47L 9/0472 |
| 2021/0045598 | A1 | 2/2021 | Krebs | |
| 2021/0076894 | A1 | 3/2021 | Wiltshire | |

FOREIGN PATENT DOCUMENTS

| | | | | | |
|---|---|---|---|---|---|
| CN | 1320409 | A | | 11/2001 | |
| CN | 2660984 | Y | | 12/2004 | |
| CN | 101120867 | A | | 2/2008 | |
| CN | 101305893 | A | | 11/2008 | |
| CN | 201162194 | Y | | 12/2008 | |
| CN | 102085081 | A | | 6/2011 | |
| CN | 101268923 | B | | 12/2011 | |
| CN | 102312413 | A | | 1/2012 | |
| CN | 102525338 | A | | 7/2012 | |
| CN | 102776853 | A | | 11/2012 | |
| CN | 103860105 | A | | 6/2014 | |
| CN | 203866748 | U | | 10/2014 | |
| CN | 104739344 | A | | 7/2015 | |
| CN | 104968247 | A | | 10/2015 | |
| CN | 105361802 | A | | 3/2016 | |
| CN | 205597859 | U | | 9/2016 | |
| CN | 106955064 | A | | 7/2017 | |
| CN | 107348894 | A | | 11/2017 | |
| CN | 107625493 | A | | 1/2018 | |
| CN | 211674011 | U | | 10/2020 | |
| EP | 1582131 | A1 | | 10/2005 | |
| EP | 2016882 | A2 | | 1/2009 | |
| EP | 2 033 559 | A2 | | 3/2009 | |
| EP | 2329755 | A2 | | 6/2011 | |
| EP | 2 449 937 | A2 | | 5/2012 | |
| EP | 2449937 | A2 | * | 5/2012 | A47L 11/22 |
| EP | 3459412 | A1 | | 3/2019 | |
| IT | I618519 | B | | 3/2018 | |
| JP | 10-57289 | A | | 3/1998 | |
| JP | 11-4790 | A | | 1/1999 | |
| KR | 97-53478 | U | | 10/1997 | |
| KR | 20-0148059 | Y1 | | 6/1999 | |
| KR | 20-0195057 | Y | | 9/2000 | |
| KR | 10-2001-0093648 | A | | 10/2001 | |
| KR | 10-2003-0016520 | A | | 3/2003 | |
| KR | 10-0400515 | B1 | | 10/2003 | |
| KR | 10-0405244 | | | 11/2003 | |
| KR | 10-2003-0093625 | | | 12/2003 | |
| KR | 10-2005-0014652 | A | | 3/2005 | |
| KR | 20-0402551 | Y1 | | 12/2005 | |
| KR | 10-2006-0032063 | A | | 5/2006 | |
| KR | 10-0582285 | B1 | | 5/2006 | |
| KR | 10-2008-0020304 | A | | 3/2008 | |
| KR | 10-0814507 | B1 | | 3/2008 | |
| KR | 10-0822785 | B1 | | 4/2008 | |
| KR | 10-0848568 | B1 | | 7/2008 | |
| KR | 10-2009-0000937 | A | | 1/2009 | |
| KR | 10-2009-0026031 | | | 3/2009 | |
| KR | 10-2010-0016787 | A | | 2/2010 | |
| KR | 10-0956737 | B1 | | 5/2010 | |
| KR | 10-2011-0087251 | A | | 9/2011 | |
| KR | 10-2012-0110271 | A | | 10/2012 | |
| KR | 20130129059 | A | * | 11/2013 | |
| KR | 1020130129059 | A | | 11/2013 | |
| KR | 20-2013-0007030 | U | | 12/2013 | |
| KR | 10-1408733 | B1 | | 6/2014 | |
| KR | 10-1578887 | B1 | | 12/2015 | |
| KR | 10-1595727 | B1 | | 2/2016 | |
| KR | 10-2016-0024735 | A | | 3/2016 | |
| KR | 10-1623871 | B1 | | 5/2016 | |
| KR | 10-2016-0065611 | A | | 6/2016 | |
| KR | 10-2016-0088549 | A | | 7/2016 | |
| KR | 10-2016-0090571 | A | | 8/2016 | |
| KR | 10-2016-0098932 | A | | 8/2016 | |
| KR | 10-1655684 | B1 | | 9/2016 | |
| KR | 101655684 | B1 | * | 9/2016 | |
| KR | 10-1664686 | B1 | | 10/2016 | |
| KR | 2016-0150433 | A | | 12/2016 | |
| KR | 10-2017-0028758 | | | 3/2017 | |
| KR | 10-2017-0028765 | | | 3/2017 | |
| KR | 10-2017-0085313 | A | | 7/2017 | |
| KR | 10-2017-0086401 | A | | 7/2017 | |
| KR | 10-2017-0136856 | A | | 12/2017 | |
| KR | 10-1805135 | B1 | | 12/2017 | |
| KR | 10-2018-0023401 | A | | 3/2018 | |
| KR | 10-2018-0098530 | A | | 9/2018 | |
| KR | 10-2018-0008248 | A | | 10/2018 | |

(56) References Cited

FOREIGN PATENT DOCUMENTS

| | | | | |
|---|---|---|---|---|
| TW | 123375 | | 11/1989 | |
| TW | 201002262 | A1 | 1/2010 | |
| TW | M469865 | U | 1/2014 | |
| TW | I483856 | B | 5/2015 | |
| TW | 201607490 | A | 3/2016 | |
| TW | I568402 | B | 2/2017 | |
| TW | 201707632 | A | 3/2017 | |
| TW | 201707639 | A | 3/2017 | |
| TW | 201707640 | A | 3/2017 | |
| TW | 201720359 | A | 6/2017 | |
| TW | 201731443 | A | 9/2017 | |
| TW | 201740856 | A | 12/2017 | |
| TW | 201740857 | A | 12/2017 | |
| TW | 201740861 | A | 12/2017 | |
| TW | 201740868 | A | 12/2017 | |
| TW | 201838576 | A | 11/2018 | |
| WO | WO 01/07719 | A1 | 2/2001 | |
| WO | WO 2005/011461 | A1 | 2/2005 | |
| WO | WO 2010/016660 | A1 | 2/2010 | |
| WO | WO 2011/005027 | A2 | 1/2011 | |
| WO | WO 2012/014620 | A1 | 2/2012 | |
| WO | WO 2013/090143 | A1 | 6/2013 | |
| WO | WO 2014/080181 | A1 | 5/2014 | |
| WO | WO 2016/021419 | A1 | 2/2016 | |
| WO | WO 2016/031704 | A1 | 3/2016 | |
| WO | WO 2016/107634 | A1 | 7/2016 | |
| WO | WO 2016/190565 | A1 | 12/2016 | |
| WO | WO 2017/007152 | A | 1/2017 | |
| WO | WO 2018/012912 | A1 | 1/2018 | |
| WO | WO-2018012912 | A1 * | 1/2018 | ..... A47L 11/14 |
| WO | WO 2019/129362 | A1 | 7/2019 | |

OTHER PUBLICATIONS

Chinese Office Action in Chinese Application No. 201980026813.9 dated May 11, 2021 (7 pages).
Extended European Search Report, dated Jan. 5, 2022, issued in European Patent Application No. 19796167.5 (7 pages).
First Official Notice, dated Dec. 21, 2021, issued in Taiwanese Patent Application No. 110129697 (13 pages).
International Search Report issued in International Application No. PCT/KR2019/004827 dated Jul. 30, 2019 (3 pages).
International Search Report issued in International Application No. PCT/KR2019/004829 dated Jul. 26, 2019 (3 pages).
International Search Report issued in International Application No. PCT/KR2019/004931 dated Jul. 29, 2019 (3 pages).
International Search Report issued in International Application No. PCT/KR2019/004932 dated Jul. 29, 2019 (3 pages).
International Search Report issued in International Application No. PCT/KR2019/004933 dated Jul. 29, 2019 (3 pages).
Korean Action received in corresponding Korean Patent Application No. 10-2021-0034566, dated Mar. 26, 2021 (118 pages).
Korean Office Action received in corresponding Application No. KR 10-0400515 (54 pages).
Notice of Allowance, dated Dec. 6, 2021, issued in Korean Patent Application No. 10-2021-0047134 (2 pages).
Notice of Allowance, dated Jul. 21, 2020, issued by the Korean Patent Office in Application No. KR 10-2019-0044986 (4 pages).
Notice of Allowance, dated Jul. 27, 2021, issued in Korean Application No. 10-2021-0047135 (2 pages).
Office Action issued by the Korean Patent Office in Application No. KR 10-2019-0044986 (54 pages).
Office Action issued in corresponding AU Application No. 2019100837, dated Sep. 27, 2019 (7 pp.).
Office Action issued in corresponding TW Application No. 108114573, dated Dec. 20, 2019 (6 pp.).
Office Action issued in corresponding TW Application No. 108114576, dated Dec. 24, 2019 (5 pp.).
Office Action issued in corresponding TW Application No. 108114579, dated Dec. 19, 2019 (5 pp.).
Office Action, dated Nov. 11, 2020, issued in Taiwanese Application No. TW 109109680 (6 pages).
Taiwanese Notice of Allowance in Taiwanese Application No. 108114573 dated May 13, 2021 (8 pages).
Taiwanese Notice of Allowance in Taiwanese Application No. 108114579 dated May 13, 2021 (10 pages).
Taiwanese Search Report, dated Apr. 30, 2018, issued in Taiwanese Application No. 109109680 (1 page).

* cited by examiner

NOZZLE FOR CLEANER

CROSS-REFERENCE TO RELATED APPLICATIONS

This application is a Continuation of U.S. application Ser. No. 16/524,759, filed Jul. 29, 2019, which claims priority under 35 U.S.C. 119 and 35 U.S.C. 365 to Korean Patent Application No. 10-2018-0088842 (filed on Jul. 30, 2018), which is hereby incorporated by reference in its entirety.

BACKGROUND

The present disclosure relates to a nozzle for a cleaner.

The cleaner is a device which suctions or wipes dust or foreign matter in a region to be cleaned to perform a cleaning.

Such a cleaner may be classified as a manual cleaner or an automatic cleaner. When using a manual cleaner, a user directly moves the cleaner. On the other hand, an automatic cleaner is self-propelled and travels by itself.

The manual cleaner may be further classified as a canister-type cleaner, an upright-type cleaner, a handy-type cleaner, or a stick-type cleaner.

Both manual and automatic cleaners clean a floor using nozzles. In general, nozzles may be used so as to suction air and dust. According to the type of the nozzle, the nozzle may also be attached with a mop to clean a floor with the mop.

Korean Patent Registration No. 10-0405244, which is a related art 1, discloses a suction port assembly for a vacuum cleaner.

The suction port assembly of the related art 1 includes a suction port main body including a suction port.

The suction port main body includes a first suction path in the front, a second suction path in the rear, and a guide path formed between the first suction path and the second suction path.

A mop is rotatably installed on the lower end of the suction port main body, and the suction port main body includes a rotation driving unit for driving the.

The rotation driving unit includes a rotation motor and one or more gears for transmitting the power of the rotation motor to one or more rotating bodies to which mops are attached.

Meanwhile, according to the related art 1, a pair of rotating bodies disposed on both sides of the rotation driving unit are rotated using one rotating motor. Therefore, when the rotating motor fails or malfunctions, there is a problem that none of the pair of rotating bodies can be rotated.

In addition, to rotate the pair of rotating bodies using the one rotation motor, because the rotation motor is positioned at the center of the suction port main body, it is necessary to design a suction path that does not interfere with the rotation motor. This is disadvantageous because the length of the suction path is lengthened and the structure for forming the suction path is complicated.

In addition, since the related art 1 does not have a structure for supplying water to a mop, when cleaning is desired to be performed using a mop with water, there is a disadvantage that a user has to directly supply water to the mop.

Korean Patent Laid-Open Publication No. 10-2017-0028765, which is the related art 2, discloses a cleaner.

The cleaner disclosed in the related art 2 includes a cleaner main body in which a mop is rotatably installed on a lower portion thereof. The cleaner also includes a water bottle, which is mounted to a handle connected to the cleaner main body or the cleaner main body. Further, the cleaner includes a water spray nozzle, which is installed so as to spray water to the front of the cleaner main body. The cleaner also includes a water supply unit for supplying the water in the water tank to the water spray nozzle.

In the related art 2, since the water spray nozzle is sprayed forward from a front surface of the cleaner main body, there is a possibility that the sprayed water may wet other nearby structures, not a mop.

The water spray nozzle is disposed at the center of the cleaner main body, while the mop is arranged in the lateral direction. Thus, there is a problem that the mop cannot sufficiently absorb the water sprayed forward or the cleaner main body.

In addition, in a case of the related art 2, since there is no flow path for suctioning air, there is a disadvantage that the floor can only be wiped, and the user has to again manually clean foreign matter present on the floor.

SUMMARY

An objective of the present disclosure is to provide a nozzle for a cleaner in which water leaking from a water tank or received from outside the cleaner may be easily discharged to the outside.

In addition, an objective of the present disclosure is to provide a nozzle for a cleaner in which water is prevented from flowing into the nozzle even if water falls into the nozzle.

Another objective of the present disclosure is to provide a nozzle for a cleaner which can suction foreign matter (e.g. dust, debris) on a floor surface, clean the floor by wiping the floor with a rotating mop, and supply water to the mop.

According to an aspect of the present disclosure, in order to solve the objectives described above, there is provided a nozzle for a cleaner, including: a nozzle housing; a rotary cleaning unit rotatably disposed below the nozzle housing and having a rotation plate to which a mop may be attached; a driving device provided in the nozzle housing and including a driving motor for driving the rotary cleaning unit; a control board installed in the nozzle housing and controlling the driving motor; and a water tank detachably mounted on an upper side of the nozzle housing and storing water to be supplied to the rotary cleaning unit.

A drain hole may be formed at the bottom of the nozzle housing to discharge water flowing into the nozzle housing from within the nozzle housing to outside the nozzle housing so that water can be smoothly discharged from the nozzle housing.

The nozzle housing may further include a blocking rib disposed around the drain hole in the nozzle housing to block water from flowing to the control board.

The water tank may include a coupling rib for coupling to the nozzle housing, and the nozzle housing may include a rib insertion hole into which the coupling rib is inserted. The blocking rib may be positioned closer to the control board than the rib insertion hole.

In one exemplary embodiment, the nozzle housing may include a suction flow path for suctioning air, and the suction flow path may include a first flow path extending in the lateral direction and a second flow path extending rearward from the first flow path.

The drain hole may be positioned between the first flow path and the rotation cleaning unit, or may be positioned to overlap with the rotation cleaning unit in the vertical direction.

In one exemplary embodiment, the nozzle for a cleaner may further include a regulating unit passing through an opening on the rear side of the nozzle housing and regulating the discharge of water in the water tank, and a supporting portion installed in the nozzle housing and supporting the regulating unit passing through the opening.

The nozzle housing may include a nozzle base on which the control board may be installed, and a nozzle cover which may be seated on the upper side of the nozzle base and on which the regulating unit may be installed, in which the nozzle base may include an outer wall spaced apart from the nozzle cover in a state where the nozzle cover is seated on the nozzle base.

The outer wall may be positioned between the control board and the nozzle cover such that water flowing from the outside may be prevented from flowing to a side of the control board, and a gap between the support portion and the nozzle cover may be positioned between the outer wall and the wall of the nozzle cover.

The nozzle of the present embodiment may further include a connection tube connected to the nozzle housing and guiding air.

The nozzle housing may include an extension portion extending rearward to support the connection tube, the extension portion may include a pair of supporting rib which may be spaced apart from each other in the lateral direction and in which the height thereof may be lowered and rounded as being close to each other.

The nozzle housing may be provided with a blocking wall formed around the extension portion and configured to block the flow of the water dropped to the extension portion to the control board.

DETAILED DESCRIPTION

Figure 1:
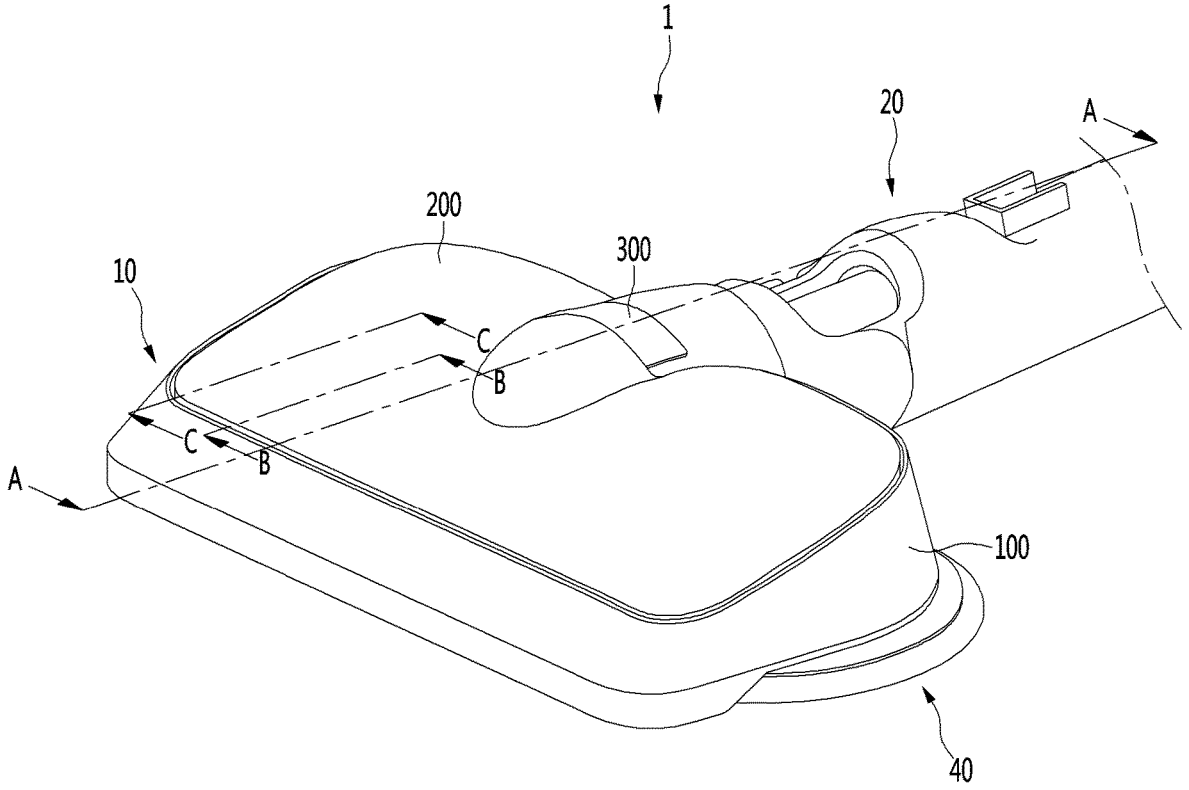
FIG. 1 and FIG. 2 are perspective views illustrating a nozzle for a cleaner according to an exemplary embodiment of the present disclosure.

Hereinafter, some exemplary embodiments of the present disclosure will be described in detail with reference to the accompanying drawings. It should be noted that when components in the drawings are designated by reference numerals, the same components have the same reference numerals as far as possible even though the components are illustrated in different drawings. Further, in the description of the exemplary embodiments of the present disclosure, detailed descriptions of well-known configurations or functions will be omitted for conciseness and clarity.

Also, in the description of the exemplary embodiments of the present disclosure, the terms such as first, second, A, B, (a) and (b) may be used. Each of the terms should be understood as merely distinguishing the corresponding component from other components, and should not be understood as delimiting an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
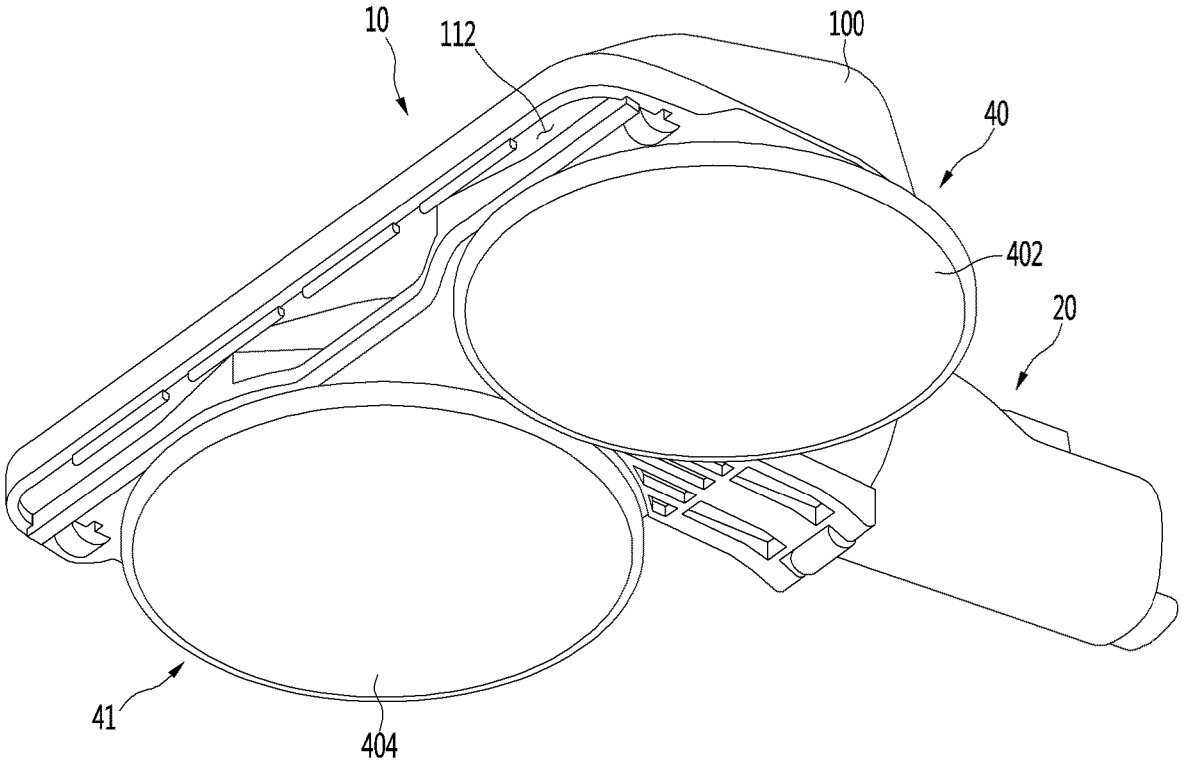
Figure 3:
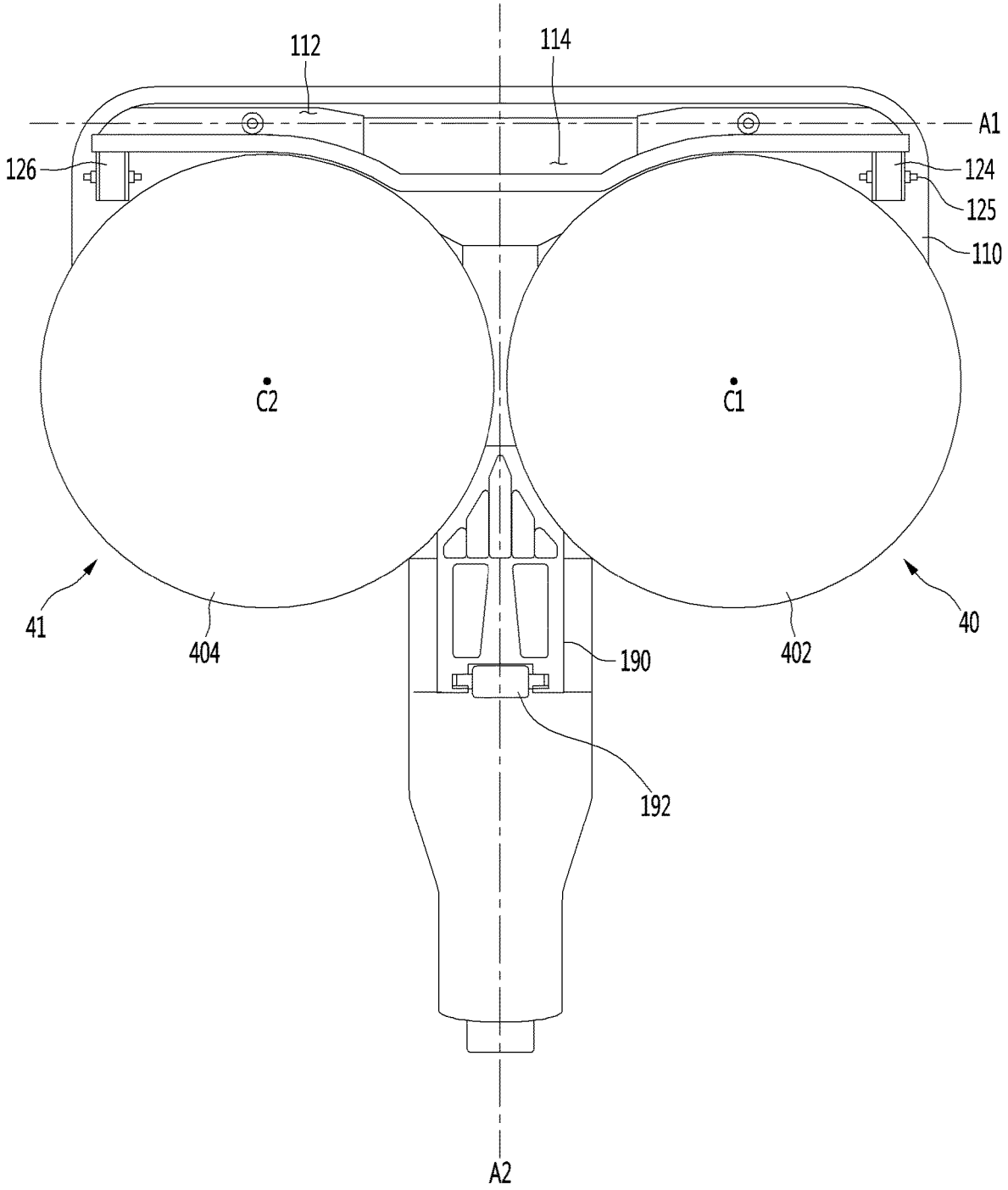
FIG. 3 is a bottom view illustrating a nozzle for a cleaner according to an exemplary embodiment of the present disclosure.
Figure 4:
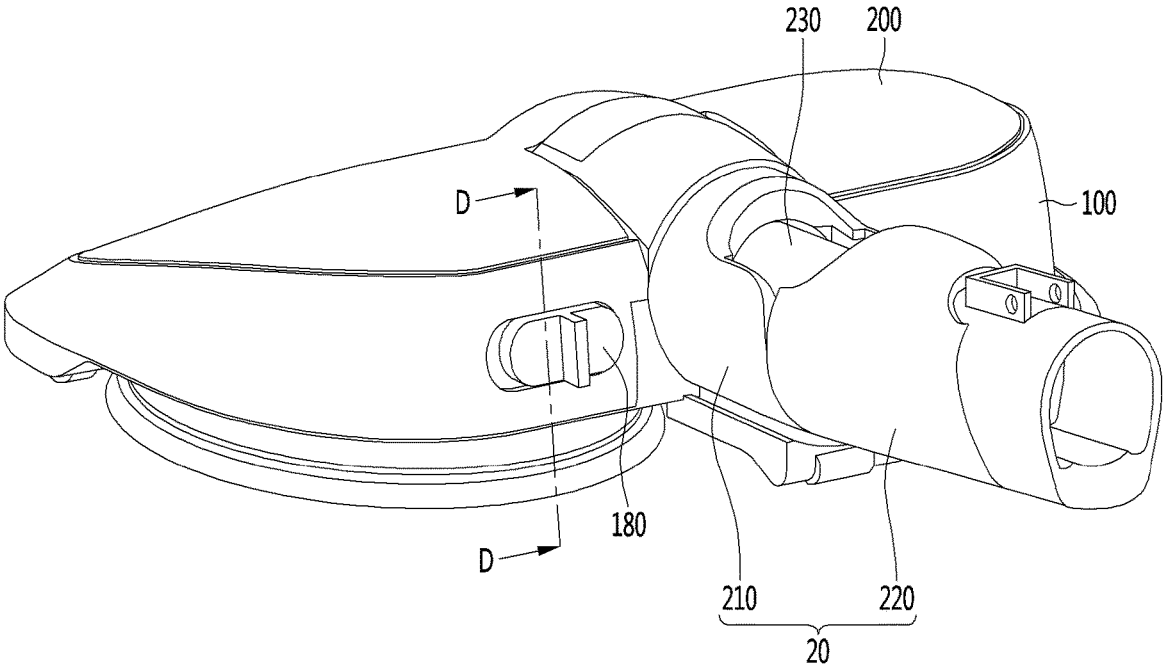
FIG. 4 is a perspective view illustrating the nozzle for the cleaner of FIG. 1 viewed from the rear side.
Figure 5:
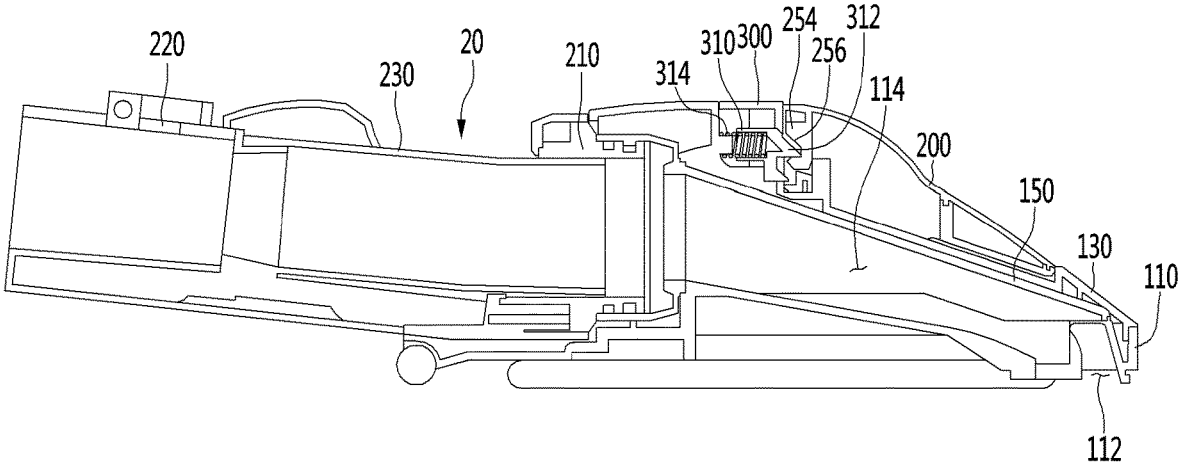
FIG. 5 is a sectional view taken along line A-A of FIG. 1.

FIG. 1 and FIG. 2 are perspective views illustrating a nozzle for a cleaner according to an exemplary embodiment of the present disclosure, FIG. 3 is a bottom view illustrating a nozzle for a cleaner according to an exemplary embodiment of the present disclosure, FIG. 4 is a perspective view illustrating an exemplary nozzle for the cleaner of FIG. 1 viewed from the rear side, and FIG. 5 is a sectional view taken along line A-A of FIG. 1.

Referring to FIG. 1 to FIG. 5, a nozzle 1 of a cleaner (hereinafter referred to as "nozzle") according to an exemplary embodiment of the present disclosure includes a nozzle main body 10, and a connection tube 20 which may be movably connected to the nozzle main body 10.

The nozzle 1 of the present embodiment may, for example, be connected to a handy type cleaner or to a canister type cleaner.

The nozzle 1 itself may include a battery to supply power to a power consumption unit, or may be operated by receiving power from the cleaner.

A cleaner to which the nozzle 1 may be connected may include a suction motor. The suction motor may be capable of generating a suction force sufficient to allow nozzle 1 to suction foreign matter and air adjacent a bottom surface of nozzle 1.

Accordingly, in the disclosed exemplary embodiment, the nozzle 1 may perform a function of suctioning foreign matter and air on the floor and guiding the foreign matter and air to the cleaner.

Although not limited thereto, the connection tube 20 may be connected to a rear central portion of the nozzle main body 10 to guide the suctioned air to the cleaner.

The nozzle 1 may further include rotary cleaning units 40 and 41 rotatably disposed below the nozzle main body 10.

For example, a pair of rotary cleaning units 40 and 41 may be arranged in a lateral direction, which may be generally perpendicular to an axial direction of main body 10 and connection tube 20. The pair of rotary cleaning units 40 and 41 may be independently rotatable. For example, the nozzle 1 may include a first rotary cleaning unit 40 and a second rotary cleaning unit 41.

Rotary cleaning units 40 and 41 may include mops 402 and 404, respectively. The mops 402 and 404 may be formed in a disc shape, for example. The mops 402 and 402 may include a first mop 402 and a second mop 404.

The nozzle main body 10 may include a nozzle housing 100 forming an outer shape. The nozzle housing 100 may include a suction flow path 112 and 114 for suctioning air.

The suction flow paths 112 and 114 may include a first flow path 112 extending in the lateral direction in the nozzle housing 100 and a second flow path 114 extending along the longitudinal axis of main body 10 and connection tube 20 in a front to rear direction. The second flow path 114 may fluidly communicate with the first flow path 112.

The first flow path 112 may be positioned at a front end portion of a lower surface of the nozzle housing 100, as an example.

The second flow path 114 may extend rearward from the first flow path 112. For example, the second flow path 114 may extend rearward from a central portion of the first flow path 112 toward the connection tube 20.

Accordingly, a centerline A1 of the first flow path 112 may extend in the lateral horizontal direction. A centerline A2 of the second flow path 114 may extend in the front and rear direction and may intersect the centerline A1 of the first flow path 112.

The centerline A2 of the second flow path 114 may be positioned at a position where the nozzle main body 10 is bisected right and left, as an example.

A portion of the mops 402 and 404 may protrude outside of the nozzle 1 when the rotation cleaning units 40 and 41 may be connected to the lower side of the nozzle main body 10. In this configuration, rotation cleaning units 40 and 41 may clean not only portions of a floor located directly below the nozzle but also portions of the floor located outside the nozzle 1.

For example, the mops 402 and 404 may protrude not only on both sides of the nozzle 1 but also from the rear of the nozzle 1.

The rotation cleaning units 40 and 41 may be positioned on a rear side of the first flow path 112 below the nozzle main body 10, for example.

Therefore, when the nozzle 1 advances on the floor, the floor may be cleaned by the mops 402, 404 after foreign substances and air on the floor are suctioned by the first flow path 112.

In the present embodiment, the first rotation center C1 of the first rotation cleaning unit 40 (for example, rotation center of rotation plate 420, see FIG. 6) and the second rotation center C2 of the second rotation cleaning unit 41 (for example, rotation center of rotation plate 440, see FIG. 6) may be spaced apart from each other in the lateral direction.

The centerline A2 of the second flow path 114 may be positioned in a region between the first rotation center C1 and the second rotation center C2.

The nozzle housing 100 may include a nozzle base 110 and a nozzle cover 130 coupled to an upper side of the nozzle base 110.

The nozzle base 110 may include the first flow path 112. The nozzle housing 100 may include a flow path forming portion 150 forming the second flow path 114 together with the nozzle base 110.

The flow path forming portion 150 may be coupled to an upper center portion of the nozzle base 110 and an end portion of the flow path forming portion 150 may be connected to the connection tube 20.

Accordingly, since the second flow path 114 may extend substantially in a straight line shape in the front and rear direction by the disposition of the flow path forming portion 150, a length of the second flow path 114 may be minimized, and thus the flow path loss in the nozzle 1 can be minimized.

The front portion of the flow path forming portion 150 may cover an upper side of the first flow path 112. The flow path forming portion 150 may be disposed to be inclined upward from the front end portion toward the rear side.

Therefore, a height of a front portion of the flow path forming portion 150 may be lower than a height of the rear portion of the flow path forming portion 150.

According to the disclosed exemplary embodiment, since the height of the front portion of the flow path forming portion 150 is low, there is an advantage that the height of the front portion of the entire height of the nozzle 1 can be reduced. The lower the height of the nozzle 1, the more likely it is that the nozzle 1 can be drawn into a narrow space, for example, below a piece of furniture or a chair.

The nozzle base 110 may include an extension portion 190 for supporting the connection tube 50. The extension portion 190 may extend rearward from the rear end of the nozzle base 110.

The connection tube 50 may include a first connection tub 210 connected to an end of the flow path forming portion 150, a second connection tube 220 rotatably connected to the first connection tube 210, and a guide tube 230 for communicating the first connection tube 210 with the second connection tube 220.

The first connection tube 210 may be seated on the extension portion 190 and the second connection tube 220 may be connected to an extension tube or nose of the cleaner.

A plurality of rollers for smooth movement of the nozzle 1 may be provided on the lower side of the nozzle base 110.

For example, the first roller 124 and the second roller 126 may be positioned behind the first flow path 112 on the nozzle base 110. The first roller 124 and the second roller 126 may be spaced apart from each other in the lateral direction.

According to the disclosed exemplary embodiment, the first roller 124 and the second roller 126 may be disposed behind the first flow path 112 so that the first flow path 112 can be positioned as close as possible to the front end portion of the nozzle base 110 and thus the area which can be cleaned by using the nozzle 1 can be increased.

As the distance from the front end portion of the nozzle base 110 to the first flow path 112 increases, the area in which the suction force does not apply in front of the first flow path 112 during the cleaning process increases, and thus the area where the cleaning is not performed may be increased.

On the other hand, according to the disclosed exemplary embodiment, a distance from the front end portion of the nozzle base 110 to the first flow path 112 can be minimized, and thus the cleanable area may be increased.

In addition, by disposing the first roller 124 and the second roller 126 behind the first flow path 112, the length of the first flow path 112 in the lateral direction may be maximized.

In other words, the distance between both end portions of the first flow path 112 and both end portions of the nozzle base 110 may be minimized.

In the disclosed exemplary embodiment, the first roller 124 may be positioned in a space between the first flow path 112 and the first mop 402. The second roller 126 may be positioned in a space between the first flow path 112 and the second mop 404.

Each of the first roller 124 and the second roller 126 may be rotatably connected to a respective shaft 125. The shaft 125 may be fixed to the lower side of the nozzle base 110 and may extend so the lateral direction.

The distance between the shaft 125 and the front end portion of the nozzle base 110 may be longer than the distance between the front end portion of the nozzle base 110 and each of the mops 402 and 404 (or a rotation plate described later).

At least a portion of each of the rotation cleaning units 40 and 41 (mop and/or rotation plate) may be positioned between the shaft 125 of the first roller 124 and the shaft 125 of the second roller 126.

Accordingly, the rotation cleaning units 40 and 41 may be positioned as close as possible to the first flow path 112, and the area to be cleaned by the rotation cleaning units 40 and 41 of the floor on which the nozzles 1 are positioned may be increased, and thus the floor cleaning performance is improved.

Although only two rollers 124, 126 have been described above, the number of rollers is not so limited. For example, the nozzle 1 may be supported at three points. In other words, a third roller 192 may be provided on the extension portion 190 of the nozzle base 110.

The third roller 192 may be positioned behind mops 402, 404 to prevent interference with mops 402, 404.

The nozzle main body 10 may further include a water tank 200 to supply water to the mops 402 and 404.

The water tank 200 may be detachably connected to the nozzle housing 100. The water in the water tank 200 may be supplied to each of the mops 402 and 404 when the water tank 200 is mounted on the nozzle housing 100.

The nozzle main body 10 may further include an operating unit 300 that may be configured to separate the water tank 200 from the nozzle main body 10 when the water tank 200 is mounted on the nozzle housing 100.

The operating unit 300 may be provided on an upper side of the nozzle housing 100 as an example. The nozzle housing 100 may be provided with a first coupling unit 310 for coupling with the water tank 200 and the water tank 200 may be provided with a second coupling unit 254 for coupling with the first coupling unit 310.

The operating unit 300 may be disposed so as to be capable of vertically moving in the nozzle housing 100. The first coupling unit 310 may be moved under the operation force of the operating unit 300 at the lower side of the operating unit 300.

For example, the first coupling unit 310 may be configured to move in the front and rear direction. For this purpose, the operating unit 300 and the first coupling unit 310 may include inclined surfaces contacting each other.

When the operating unit 300 is lowered by the inclined surfaces, the first coupling unit 310 may move horizontally.

The first coupling, unit 310 may include a hook 312 for engaging with the second coupling unit 254 and the second coupling unit 254 may include a groove 256 for inserting the hook 312.

The first coupling unit 310 may be resiliently supported by the elastic member 314 when the first coupling unit 310 is coupled to the second coupling unit 254.

In the disclosed exemplary embodiment, the operating unit 300 may be positioned directly above the second flow path 114, for example. For example, the operating unit 300 may be disposed to overlap the centerline A2 of the second flow path 114 in the vertical direction.

The nozzle main body 10 may include an adjusting unit 180 for adjusting an amount of water discharged from the water tank 200. For example, the adjusting unit 180 may be positioned on the rear side of the nozzle main body 10.

The adjusting unit 180 may be configured to be operated by a user and the adjusting unit 180 may help prevent the water from being discharged from the water tank 200.

Alternatively, the amount of water discharged from the water tank 200 may be adjustable using the adjusting unit 180. Adjusting unit 180 may control an amount of water discharged from the water tank 200 per unit time. For example, when the adjusting unit 180 is operated, water may be discharged from the water tank 200 by a first amount per unit time, or water may be discharged by a second amount greater than the first amount per unit time.

Figure 6:
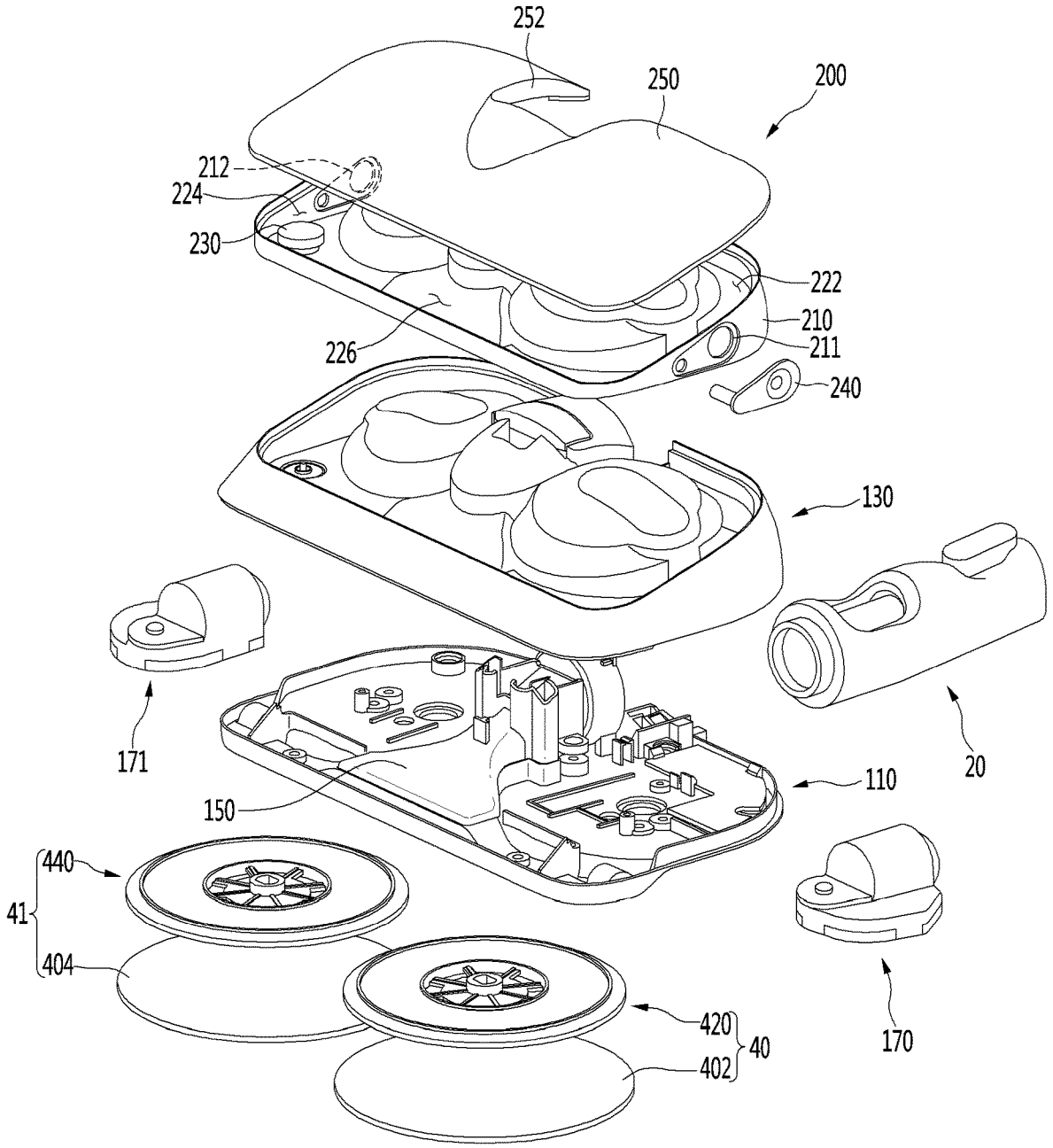
FIG. 6 and FIG. 7 are exploded perspective views illustrating a nozzle according to an exemplary embodiment of the present disclosure.
Figure 7:
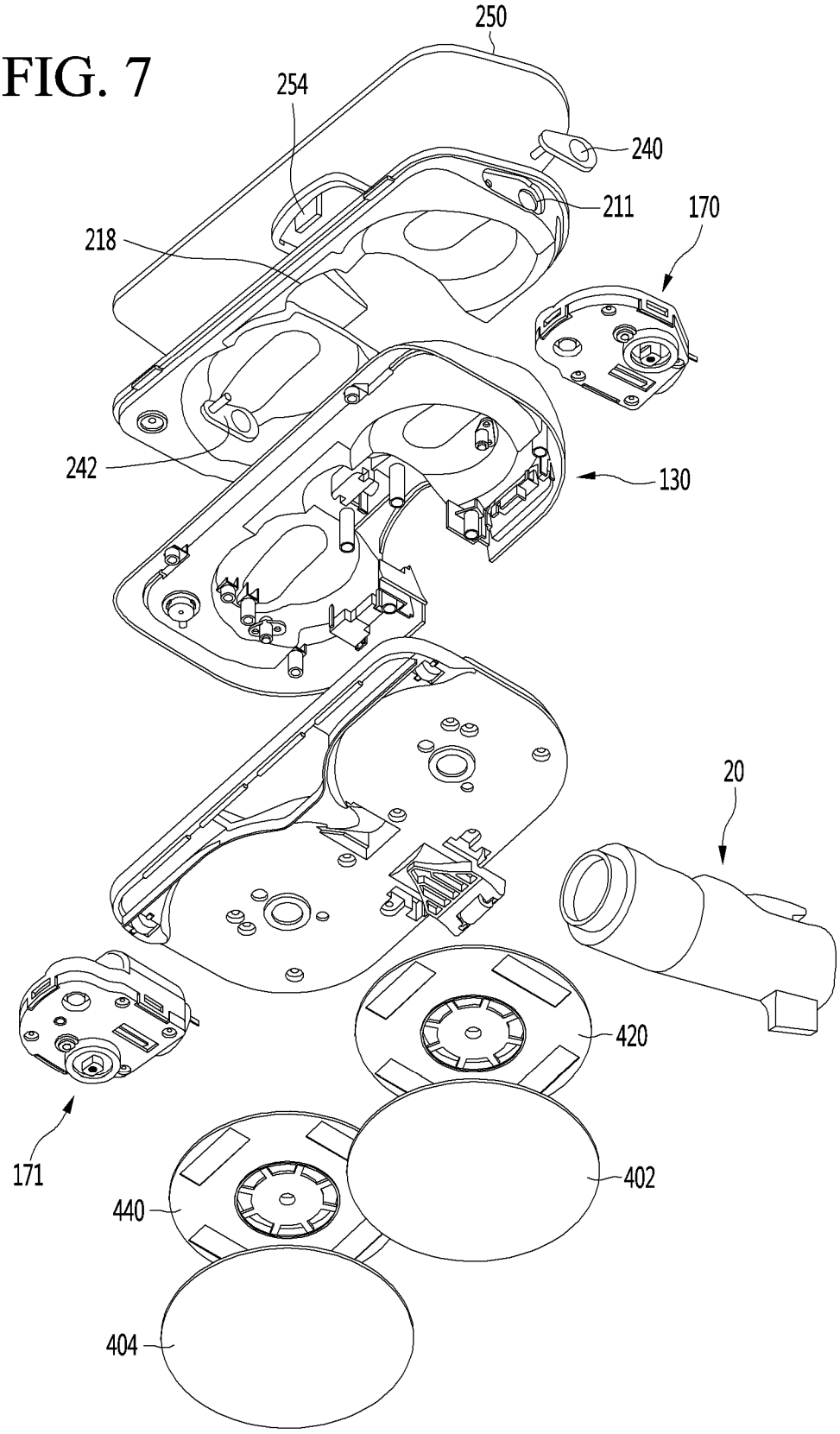
Figure 8:
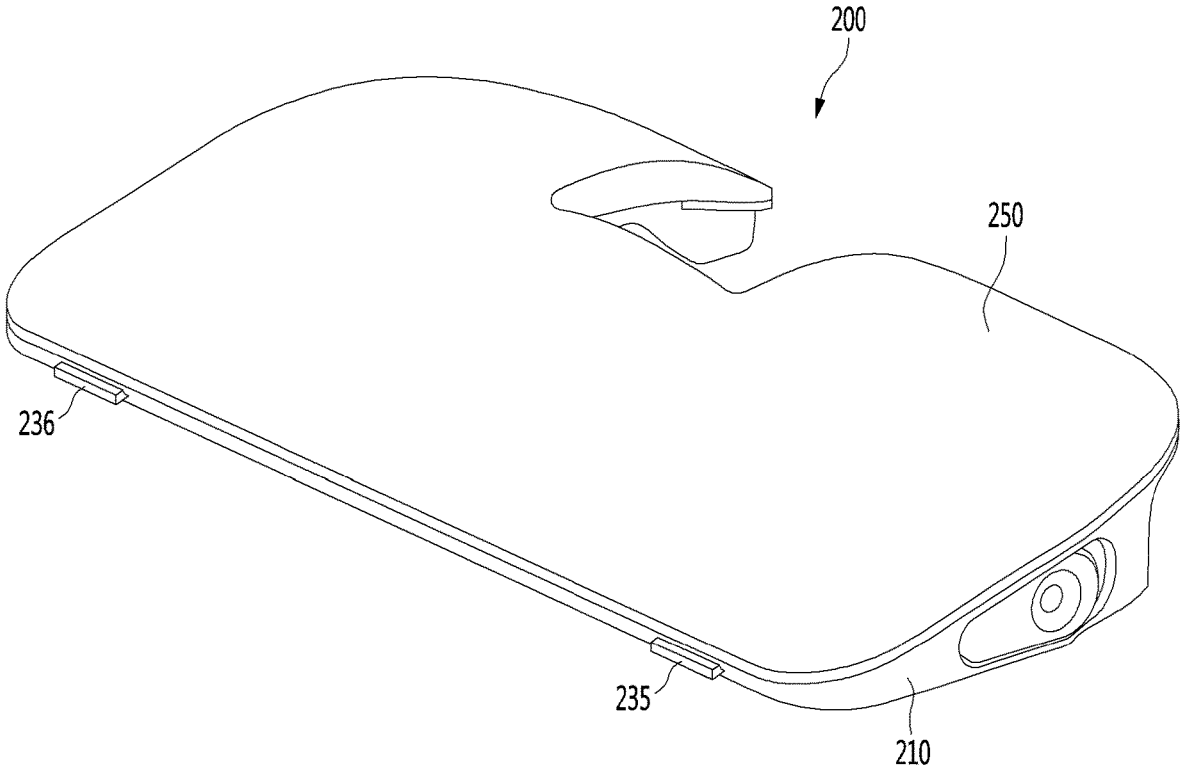
FIG. 8 and FIG. 9 are perspective views illustrating a water tank according to an exemplary embodiment of the present disclosure.
Figure 9:
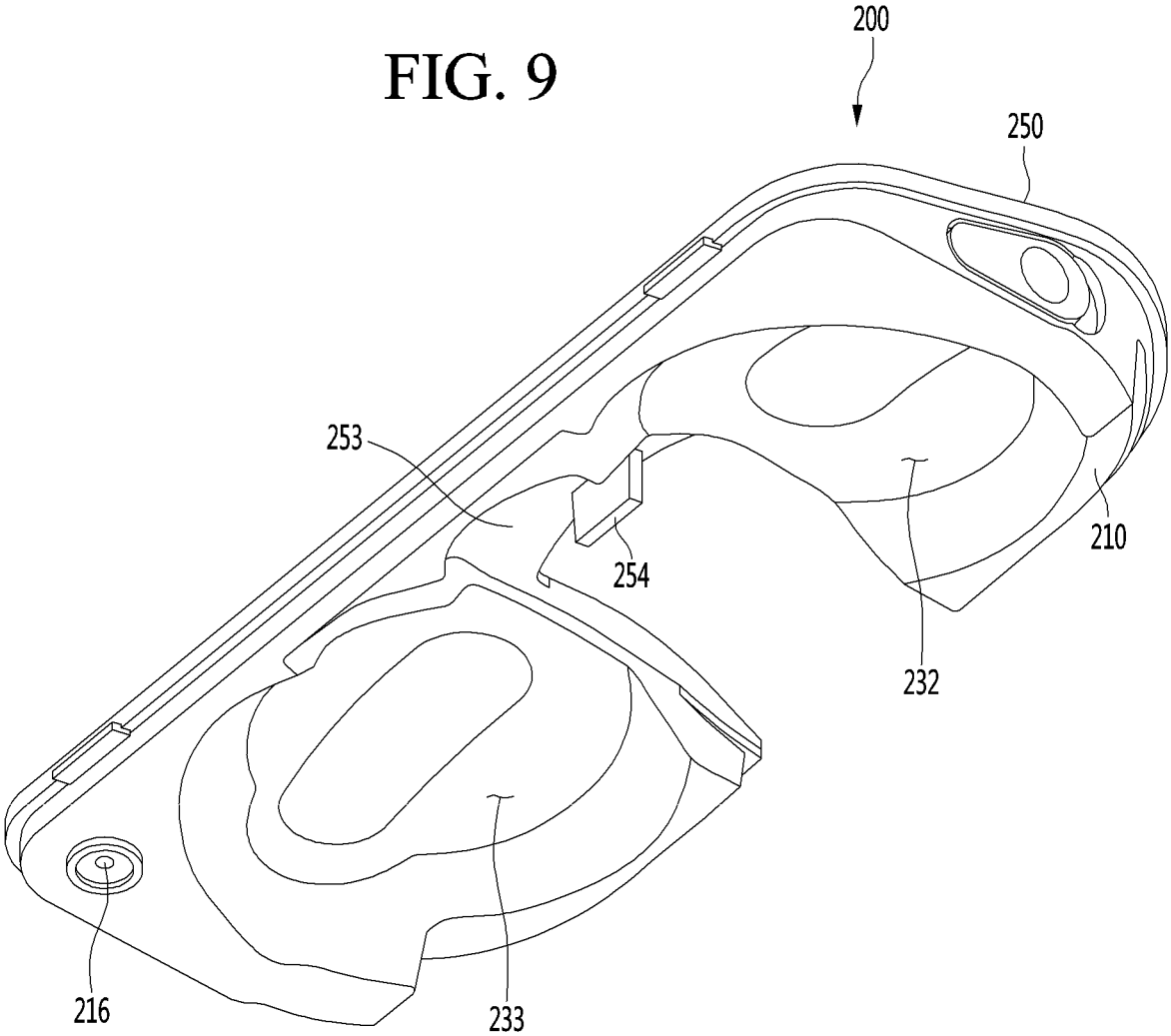

FIG. 6 and FIG. 7 are exploded perspective views of a nozzle according to an exemplary embodiment of the present disclosure, and FIG. 8 and FIG. 9 are perspective views of a water tank according to an embodiment of the present disclosure.

Referring to FIG. 3 and FIG. 6 to FIG. 9, the nozzle main body 10 may include a plurality of driving devices 170 and 171 for individually driving the respective rotation cleaning units 40 and 41, respectively.

The plurality of driving devices 170 and 171 may include a first driving device 170 for driving the first rotation cleaning unit 40 and a second driving device 171 for driving the second rotation cleaning unit 41.

Since each of the driving devices 170 and 171 operates independently, even if one of the driving devices 170 and 171 fails, there is an advantage that some of the rotation cleaning devices may be rotated using another driving device.

The first driving device 170 and the second driving device 171 may be spaced apart from each other in the lateral direction in the nozzle main body 10.

The driving devices 170 and 171 may be positioned behind the first flow path 112.

For example, the second flow path 114 may be positioned between the first driving device 170 and the second driving device 171. Therefore, even when a plurality of driving devices 170 and 171 may be provided, the driving devices 170, 171 may not interfere with the second flow path 114. Thus, a length of the second flow path 114 may be minimized.

According to the disclosed exemplary embodiment, since the first driving device 170 and the second driving device 171 are disposed on either side of the second flow pathway 114, a weight of the nozzle 1 may be uniformly distributed on the left and right sides. This may help prevent a center of gravity of the nozzle 1 from being biased toward of the left or right sides of the nozzles 1.

The plurality of driving devices 170 and 171 may be disposed in the nozzle main body 10. For example, the plurality of driving devices 170 and 171 may be seated on the upper side of the nozzle base 110 and covered with the nozzle cover 130.

Each of the rotation cleaning units 40 and 41 may further include rotation plates 420 and 440 which may be rotated by receiving power from the driving devices 170 and 171, respectively.

The rotation plates 420 and 440 may include a first rotation plate 420 which may be connected to the first driving device 170 and a second rotation plate 440 which is connected to the second driving device 171. A first mop 402 may be attached to the first rotation plate 420 and a second mop 404 may be attached to the second rotation plate 440.

The rotation plates 420 and 440 may be formed in a disc shape, and the mops 402 and 404 may be attached to the bottom surface of the rotation plates 420 and 440.

<Water Tank>

The water tank 200 may be mounted on the upper side of the nozzle housing 100. For example, the water tank 200 may be seated on the nozzle cover 130. The water tank 200 may form a portion of an outer appearance of the nozzle main body 10 when the water tank 200 is seated on the upper side of the nozzle cover 130.

The water tank 200 may include a first body 210, and a second body 250 coupled to the first body 210 and defining a chamber, in which water may be stored, together with the first body 210.

The chamber may include a first chamber 222 positioned above the first driving device 170, a second chamber 224 positioned above the second driving device 171, and a connection chamber 226 communicating the first chamber 222 with the second chamber 224 and positioned above the second flow path 114.

In the present disclosure, the volume of the connection chamber 226 may be smaller than the volume of the first chamber 222 and the second chamber 24 so that the amount of water to be stored may be increased while minimizing the height of the nozzle 1.

The water tank 200 may be formed so that the front height of water tank 200 is low that the rear height of water tank 200. The connection chamber 226 may connect the first chamber 222 and the second chamber 224 in the front portion of the water tank 200.

The water tank 200 may include a first inlet 211 for introducing water into the first chamber 222 and a second inlet 212 for introducing water into the second chamber 224.

The first inlet 211 may be covered by a first inlet cover 240 and the second inlet 212 may be covered by a second inlet cover 242. For example, each of the inlet covers 242 and 240 may be formed of a rubber material.

Each of the inlets 211 and 212 may be formed on side surfaces of the first body 210, for example.

The height of the side surfaces of the first body 210 may be the lowest at the front end portion and may become higher toward the rear side.

The inlets 211 and 212 may be positioned closer to the rear end portion than the front end portion at both side surfaces of the first body 210.

The first body 210 may include a first slot 218 for preventing interference with the operating unit 300 and the coupling units 310 and 254.

In addition, the second body 230 may include a second slot 252 for preventing interference with the operating unit 300.

The second body 230 may further include a slot cover 253 covering a portion of the first slot 218 of the first body 210 when second body 230 is coupled to the first body 210.

The second coupling unit 254 may extend downward from the slot cover 253. Accordingly, the second coupling unit 254 may be positioned within the space formed by the first slot 218.

The water tank 200 may further include coupling ribs 235 and 236 configured to couple with the nozzle cover 130 before the second coupling unit 254 of the water tank 200 is coupled with the first coupling unit 310.

The coupling ribs 235 and 236 may also help guide the coupling position of the water tank 200 in the nozzle cover 130 before the second coupling unit 254 of the water tank 200 is coupled with the first coupling unit 310.

For example, a plurality of coupling ribs 235 and 236 may protrude from the first body 110 and may be disposed so as to be spaced apart in the left and right horizontal direction.

The plurality of coupling ribs 235 and 236 may protrude forward from the front surface of the first body 110 and may be spaced apart from each other in the lateral direction.

Each of the driving devices 170 and 171 may be positioned in the nozzle housing 100 so that a portion of the nozzle housing 100 may protrude upward at both sides of the second flow path 114 adjacent driving devices 170 and 171.

The water tank 200 may form a pair of receiving spaces 232 and 233 so as to prevent the water tank 200 from interfering with a portion protruding from the nozzle housing 100.

The pair of receiving spaces 232 and 233 may be formed as recessed portions or the first body 210. The pair of receiving spaces 232 and 233 may be divided into right and left by the first slot 218.

The water tank 200 may further include a discharge port 216 through which water may be discharged. The discharge port 216 may be formed on the lower surface of the first body 210, for example.

The discharge port 216 may be opened or closed by a valve 230. The valve 230 may be disposed in the water tank 200.

In the disclosed exemplary embodiment, the discharge port 216 may be positioned below one of the first chamber 222 and the second chamber 224. In other words, the water tank 200 may include a single discharge port 216.

The reason for providing the water tank 200 with the single discharge port 216 may be to reduce the number of parts that may cause water leakage.

In other words, since there is a component (control board, driving motor, or the like) in the nozzle 1 which receives power and operates, the contact of the component with water must be completely blocked. To block the contact between the component and the water, leakage at the portion through which water is discharged at the water tank 200 may be minimized.

As the number of the discharge ports 216 in the water tank 200 is increased, a structure for preventing water leakage may additionally be required so that the structure thereof may be complicated and there may be a possibility that water leakage cannot be completely prevented even if there is a structure for preventing water leakage.

Since the height of the rear side of the water tank 200 is higher than that of the front side of the water tank 200, the discharge port 216 is positioned close to the front end portion of the first body 210 so that the water in the water tank 200 can be smoothly discharged.

<Nozzle Cover>

Figure 10:
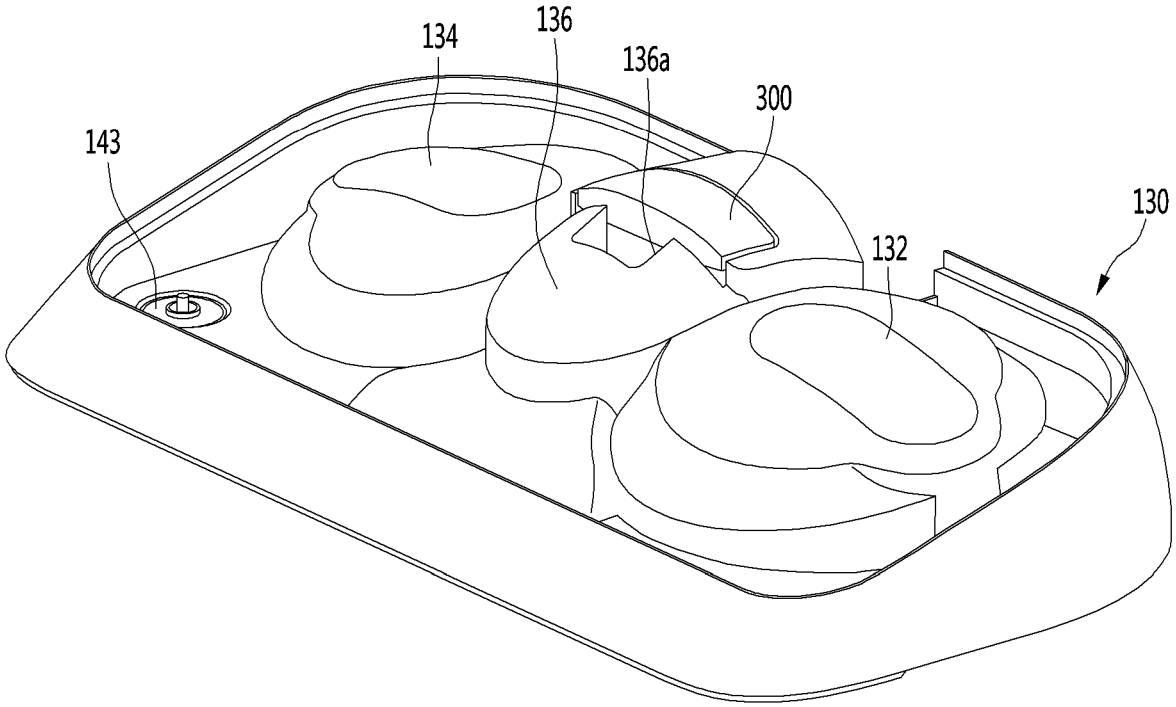
FIG. 10 is a perspective view illustrating a nozzle cover according to an exemplary embodiment of the present disclosure as viewed from above.
Figure 11:
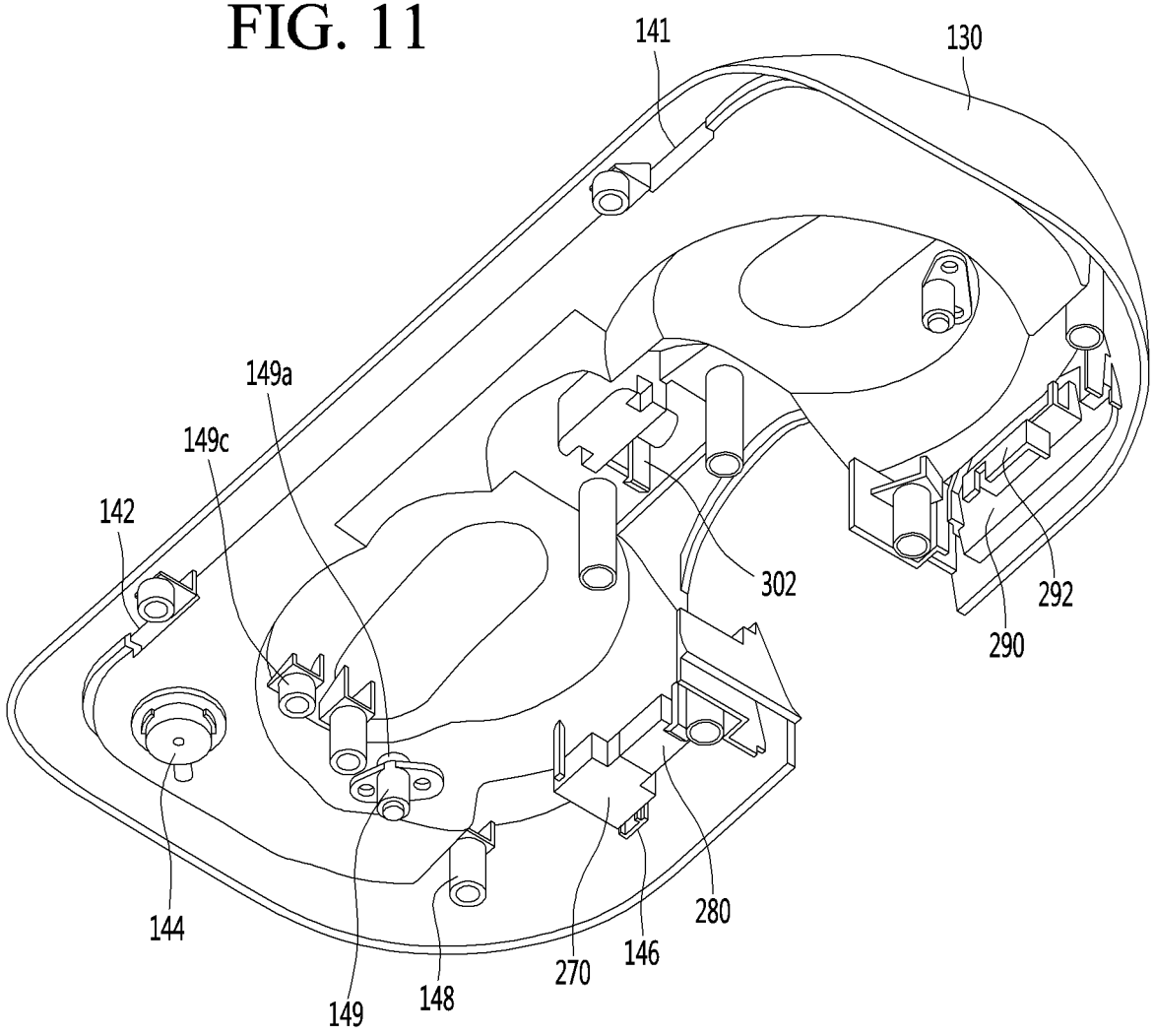
FIG. 11 is a perspective view illustrating a nozzle cover according to an exemplary embodiment of the present disclosure as viewed from below.

FIG. 10 is a perspective view illustrating a nozzle cover according to an exemplary embodiment of the present disclosure as viewed from above, and FIG. 11 is a perspective view illustrating a nozzle cover according to an exemplary embodiment of the present disclosure as viewed from below.

Referring to FIG. 10, and FIG. 11, the nozzle cover 130 may include driving unit covers 132 and 134 that may cover the upper side of each of the driving units 170 and 171.

Each of the driving unit covers 132 and 134 is a portion which may protrude upward from the nozzle cover 130. Each of the driving unit covers 132 and 134 may surround the upper side of the driving devices 170 and 171.

When the water tank 200 is seated on the nozzle cover 130, the driving unit covers 132 and 134 may be received in the receiving spaces 232 and 233, respectively, and thus interference between the components may be prevented.

In addition, in the water tank 200, the first chamber 222 and the second chamber 224 may be disposed so as to surround the periphery of each of the respective driving unit covers 132 and 134.

Thus, according to the disclosed exemplary embodiment, the volumes of the first chamber 222 and the second chamber 224 may be increased.

The first body 210 of the water tank 200 may be seated at a lower portion of the nozzle cover 130 than the driving unit cover 132 and 134.

At least a portion of the bottom of the water tank 200 may be positioned lower than the axis of the driving motor (see A3 and A4 in FIG. 21) to be described later. For example, the bottoms of the first chamber 122 and the second chamber 124 may be positioned lower than the axis of the driving motor A3 and A4, which will be described later.

The nozzle cover 130 may further include a flow path cover 136 covering the flow path forming portion 150. The flow path cover 136 may be disposed between the driving unit covers 132 and 134.

The flow path cover 136 may support the operating unit 300. The operating unit 300 may include a coupling hook 302 configured to couple to the flow path cover 136.

It may be possible to prevent the operating unit 309 from being separated upward from the flow path cover 136 when the coupling hook 302 is coupled to the flow path cover 136.

The flow path cover 136 may have an opening 136*a* into which the second coupling unit 154 may be inserted. The first coupling unit 310 may be coupled to the second coupling unit 254 when the second coupling unit 254 of the water tank 200 is inserted into the opening 136*a*.

The flow path cover 136 may be positioned in the first slot 218 of the first body 210 and the second slot 252 of the second body 250.

In the disclosed exemplary embodiment, to increase the water storage capacity of the water tank 200, a portion of the water tank 200 may be positioned on both sides of the flow path cover 136.

The nozzle cover 130 may further include rib insertion holes 141 and 142 into which the coupling ribs 235 and 236 provided in the water tank 200 may be inserted.

Accordingly, the water tank 200 may be moved downward when the coupling ribs 235 and 236 are inserted into the rib insertion holes 141 and 142, and thus the second coupling unit 254 may be coupled to the first coupling portion 310.

The nozzle cover 130 may be provided with a valve operating unit 144 for operating the valve 230 in the water tank 200. Water may flow through the valve operating unit 144.

The valve operating unit 144 may be coupled to the lower side of the nozzle cover 130, and a portion of the valve operating unit 144 may protrude upward through the nozzle cover 130.

The nozzle cover 130 may be provided with a sealer 143 for preventing water discharged from the water tank 200 from leaking from the vicinity of the valve operating unit 144.

The nozzle cover 130 may be provided with a water pump 270 for controlling an amount of water discharged from the water tank 200. The water pump 270 may be connected to a pump motor 280.

A pump installation rib 146 for installing the water pump 270 may be provided on the lower side of the nozzle cover 130.

The water pump 270 may be a pump that may operate to communicate the inlet and the outlet by expanding or contracting the valve body therein. The water pump may be realized by a well-known structure in the art, and thus a detailed description thereof will be omitted.

The valve body in the water pump 270 may be driven by the pump motor 280. Therefore, according to the disclosed exemplary embodiment, water in the water tank 200 may be continuously and stably supplied to the rotation cleaning units 40 and 41 while the pump motor 280 is operating.

The operation of the pump motor 280 can be adjusted by operating the above-described adjusting unit 180. For example, the adjusting unit 180 may select the on/off state of the pump motor 280.

Additionally or alternatively, the output (or rotational speed) of the pump motor 280 may be adjusted by the adjusting unit 280.

The nozzle cover 130 may be provided with a supporting portion 290 for movably supporting the adjusting unit 180. A variable resistance body 292 may be connected to the adjusting unit 180. A signal for controlling the pump motor 280 may be varied based on a change in resistance of the variable resistance body 292 as the variable resistance body 292 moves. Alternatively, a switch may be provided in the adjusting unit 180 and the adjusting unit 180 may be configured to operate the switch.

The nozzle cover 130 may include at least one fastening boss 148 configured to be coupled with the nozzle base 110.

In addition, the nozzle cover 130 may be provided with a spray nozzle 149 for spraying water to the rotation cleaning units 40 and 41 to be described later. For example, a pair of spray nozzles 149 may be installed on the nozzle cover 130, the spray nozzles 149 may be spaced apart from each other in the lateral direction.

The nozzle cover 130 may be provided with a nozzle installation boss 149*c* for mounting the spray nozzle 149. The spray nozzle 149 may include a connection unit 149*a* to be connected to each of the branch tubes 286 and 287 as described below (see FIG. 23).

<Nozzle Base>

Figure 12:
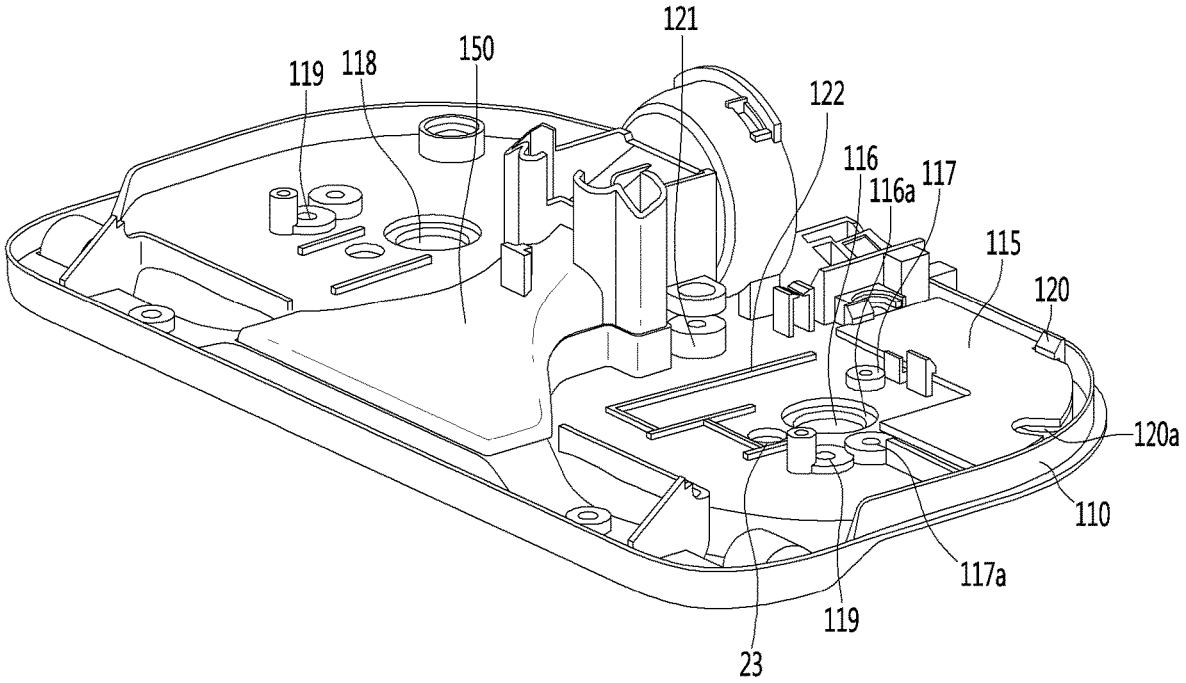
FIG. 12 is a view illustrating a state where a flow path forming portion is coupled to a nozzle base according to an exemplary embodiment of the present disclosure.
Figure 13:
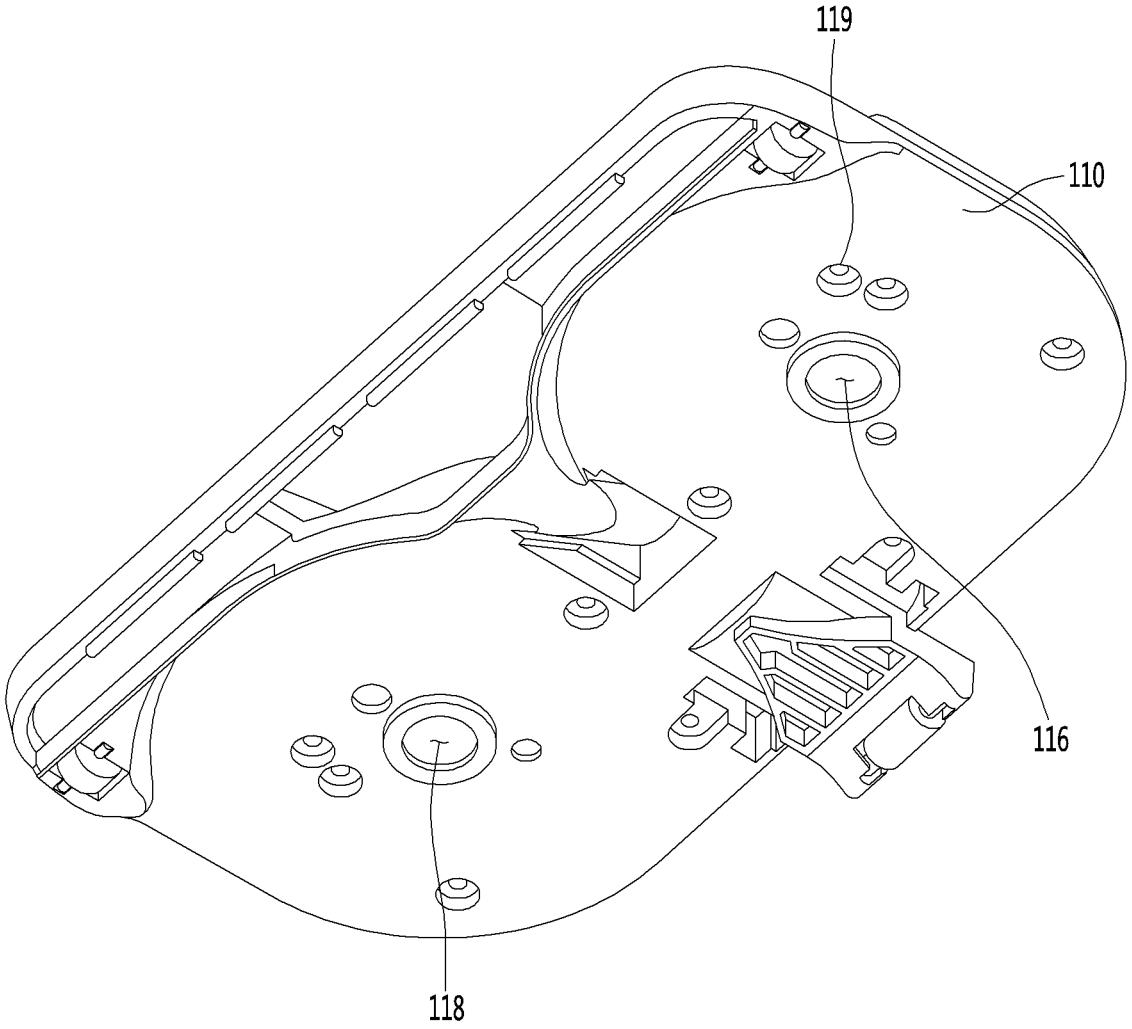
FIG. 13 is a view illustrating a nozzle base according to an exemplary embodiment of the present disclosure as viewed from below.

FIG. 12 is a view illustrating a flow path forming portion coupled to a nozzle base according to an embodiment of the present disclosure, and FIG. 13 is a view illustrating a nozzle base according to an embodiment of the present disclosure as viewed from below.

Referring to FIG. 6, FIG. 12, and FIG. 13, the nozzle base 110 may include a pair of shaft through-holes 116 and 118. Transmission shafts (to be described later) connected to each of the rotation plates 420 and 440 in each of the driving devices 170 and 171 may pass through shaft through-holes 116 and 118.

The nozzle base 110 may include a seating groove 116*a* for seating a sleeve (to be described later) provided in each of the driving devices 170 and 171, and the shaft through-holes 116 and 118 may be formed in the seating groove 116*a*.

The shaft through-holes 116 and 118 may be disposed on opposite side of the flow path forming portion 150 when the flow path forming portion 150 is coupled to the nozzle base 110.

The nozzle base 110 may be provided with a board installation portion 120 for installing a control board 115 for controlling each of the driving devices 170 and 171.

The control board 115 may be disposed in a horizontal state when the control board 115 is installed in on the board installation portion 120.

Even if water falls to the bottom of the nozzle base 110, water can be prevented from contacting the control board 115. The nozzle base 110 may be provided with a support protrusion 120*a* for supporting the control board 115 away from the bottom.

The board installation portion 120 may be positioned at one side of the flow path forming portion 150 in the nozzle base 110, although not limited thereto. For example, the control board 115 may be disposed at a position adjacent to the adjusting unit 180.

As a result, the structure for connection between the control board 115 and the variable resistance body 292 (or the switch) may be simplified.

The nozzle base 110 may include supporting ribs 122 for supporting the lower sides of each of the driving devices 170 and 171 and fastening bosses 117 and 117*a* for fastening each of the driving devices 170 and 171.

Each of the driving devices 170 and 171 may be positioned spaced apart from the bottom of the nozzle base 110, by the supporting ribs 122. This may help to prevent water from coming in contact with the driving devices 170 and 171 even if water leaks to the bottom of the nozzle base 110.

The nozzle base 110 may include nozzle holes 119. Spray nozzles 149 may extend through the nozzle holes 119.

A portion of the spray nozzle 149 coupled to the nozzle cover 130 may pass through the nozzle hole 119 when the nozzle cover 130 is coupled to the nozzle base 110.

The nozzle base 110 may include an avoidance hole 123 for preventing interference with the structures of each of the driving devices 170 and 171, and a fastening boss 121 for fastening the flow path forming portion 150.

<Water Discharge Structure in Nozzle Housing>

Figure 14:
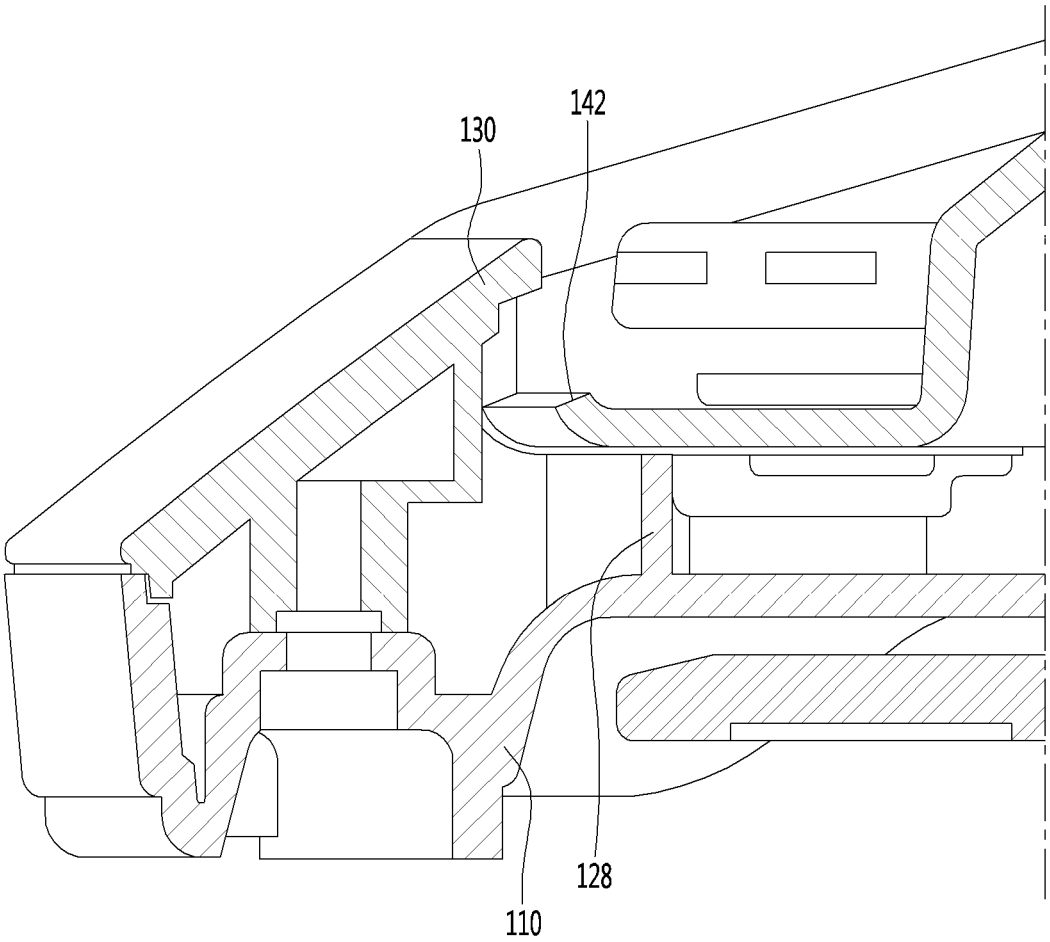
FIG. 14 is a sectional view taken along line B-B in FIG. 1.
Figure 15:
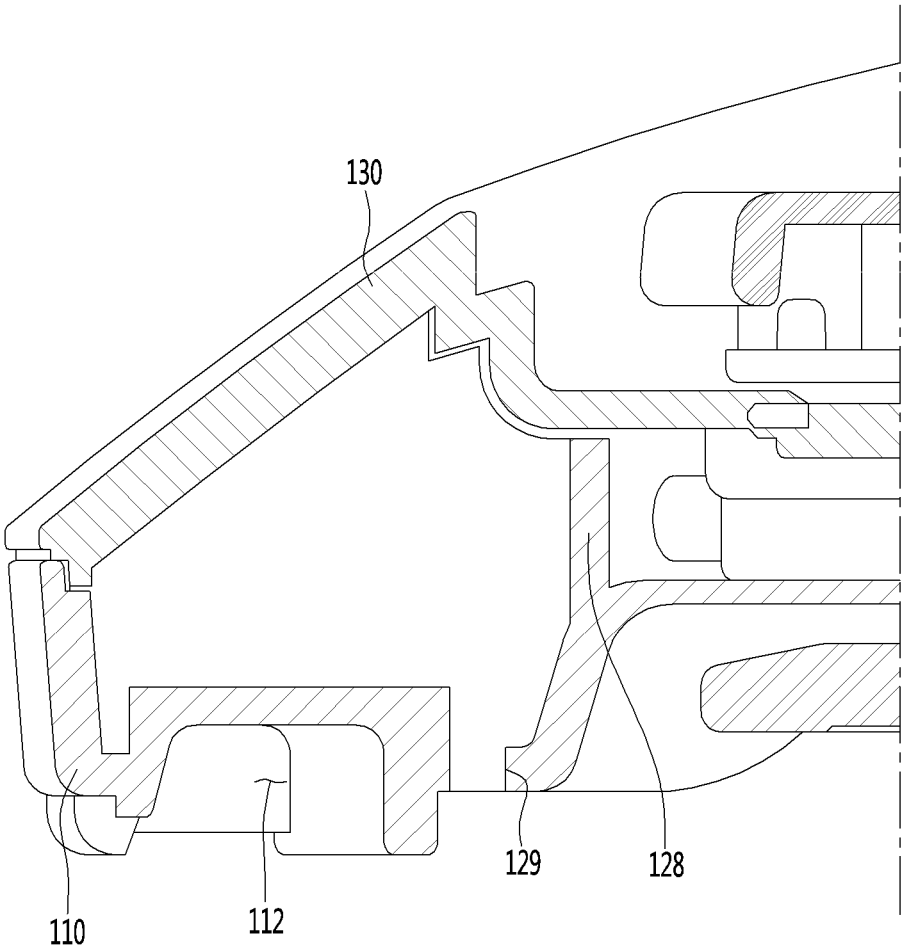
FIG. 15 is a sectional view taken along line C-C in FIG. 1.

FIG. 14 is a sectional view taken along line B-B in FIG. 1, and FIG. 15 is a sectional view taken along line C-C in FIG. 1.

Referring to FIGS. 14 and 15, the nozzle cover 130 may include rib insertion hole 141 and 142. The coupling ribs 235 and 236 of the water tank 200 may be inserted into the rib insertion holes 141 and 142, respectively.

The coupling ribs 235 and 236 may be separated from inner surfaces of the rib insertion holes 141 and 142, respectively, by gaps when the coupling ribs 235 and 236 are inserted into the rib insertion holes 141 and 142.

If water leaks to the upper side of the nozzle cover 130 or water falls on the upper side of the nozzle cover 130, water existing on the upper side of the nozzle cover 130 may flow into the nozzle housing 100 through the rib insertion hole 141 and 142.

Since the control board 115 is installed on the nozzle base 110, water passing through the rib insertion holes 141 and 142 should be prevented from flowing to the control board 115.

Accordingly, in the disclosed exemplary embodiment, the nozzle base 110 may be provided with a blocking rib 128 protruding upward from the bottom surface.

The blocking rib 128 may be positioned behind the rib insertion holes 141 and 142 and may be in contact with a lower surface of the nozzle cover 130 or may extend to a portion adjacent to the lower surface of the nozzle cover 130. In other words, the blocking rib 128 may be positioned closer to the control board 115 than the rib insertion holes 141 and 142.

A drain hole 129 may be forced in the nozzle base 130 so that the water flowing into the nozzle housing 100 may be rapidly discharged outside the nozzle housing. The blocking rib 128 may be positioned around the drain hole 129. For example, the blocking rib 128 may be positioned behind the drain hole 129.

The blocking rib 128 may be positioned further away from the drain hole 129 than the rib insertion holes 141 and 142.

The drain hole 129 may be positioned between the first flow path 112 and the rotation cleaning units 40 and 41. In this case, the water discharged through the drain hole 129 may drop to the floor, and the water dropped to the floor may be wiped by the rotation cleaning units 40 and 41.

Alternatively, the drain holes 129 may be disposed to overlap with the rotation cleaning units 40 and 41 in the vertical direction. In this case, the water discharged through the drain hole 129 may be supplied to the rotation cleaning units 40 and 41.

Figure 16:
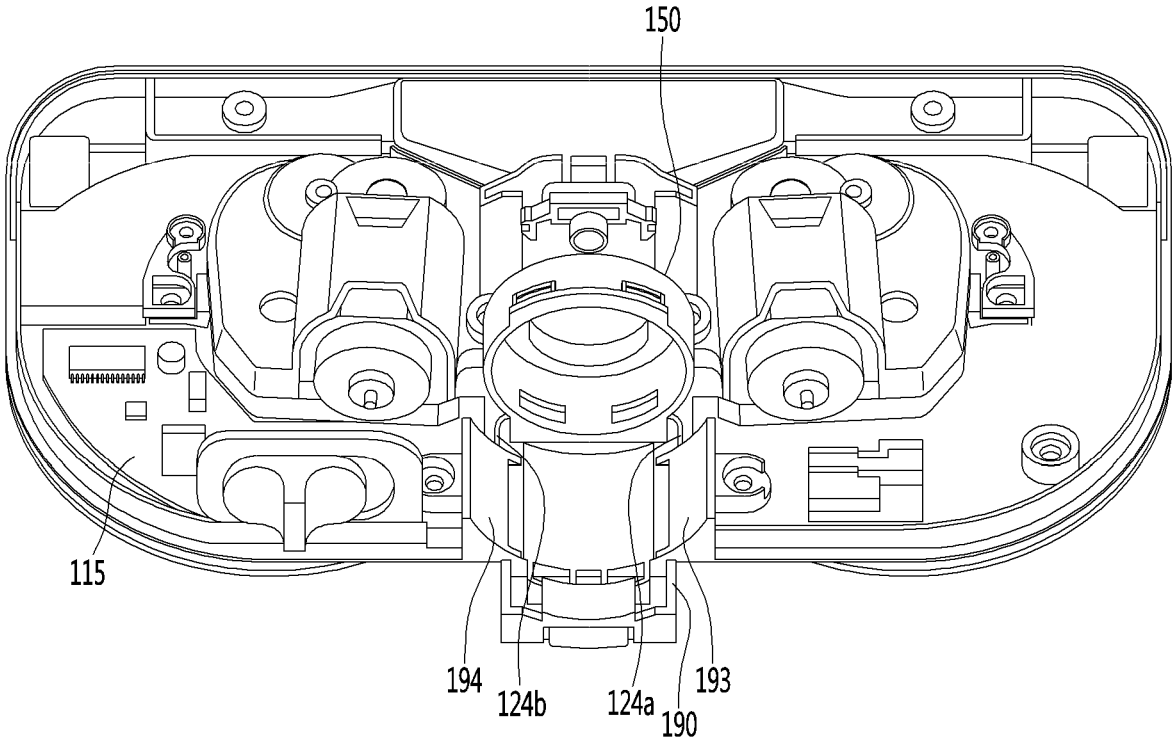
FIG. 16 is a view illustrating an extension portion of a nozzle base according to an exemplary embodiment of the present disclosure.

FIG. 16 is a view illustrating an extension portion of the nozzle base according to an exemplary embodiment of the present disclosure.

Referring to FIG. 16, the nozzle base 110 may have the extension portion 190 extending rearward as described above.

Since the control board 115 may be positioned adjacent to the extension portion 190, when the water drops on the connection tube 20 positioned on the upper side of the extension portion 190, it may be necessary to prevent water from being drawn into the nozzle housing 100 along the extension portion 190.

In the disclosed exemplary embodiment, the extension portion 190 may include a pair of supporting ribs 193 and 194 which may be configured to support the connection tube 20 and may be spaced apart in the lateral direction.

The pair of supporting ribs 193 and 194 may be spaced apart from each other in the lateral direction. Ribs 193 and 194 may include curved surfaces facing each other.

The curved surfaces of supporting ribs 193 and 194 may help the water falling along the connection tube 20 to flow into a space between the pair of supporting ribs 193 and 194.

The nozzle base 110 may include blocking walls 124*a* and 124 for preventing water existing on the upper surface of the extension portion 190 from flowing toward a side of the control board 115.

The blocking walls 124*a* and 124 may be positioned closer to the first flow path 190 than the extension portion 190 and may be positioned below the flow path forming portion 150. Since the blocking walls 124*a* and 124*b* block a path through which water may flow to the control board 115, it may be possible to prevent water from coming in contact with the control board 115.

Figure 17:
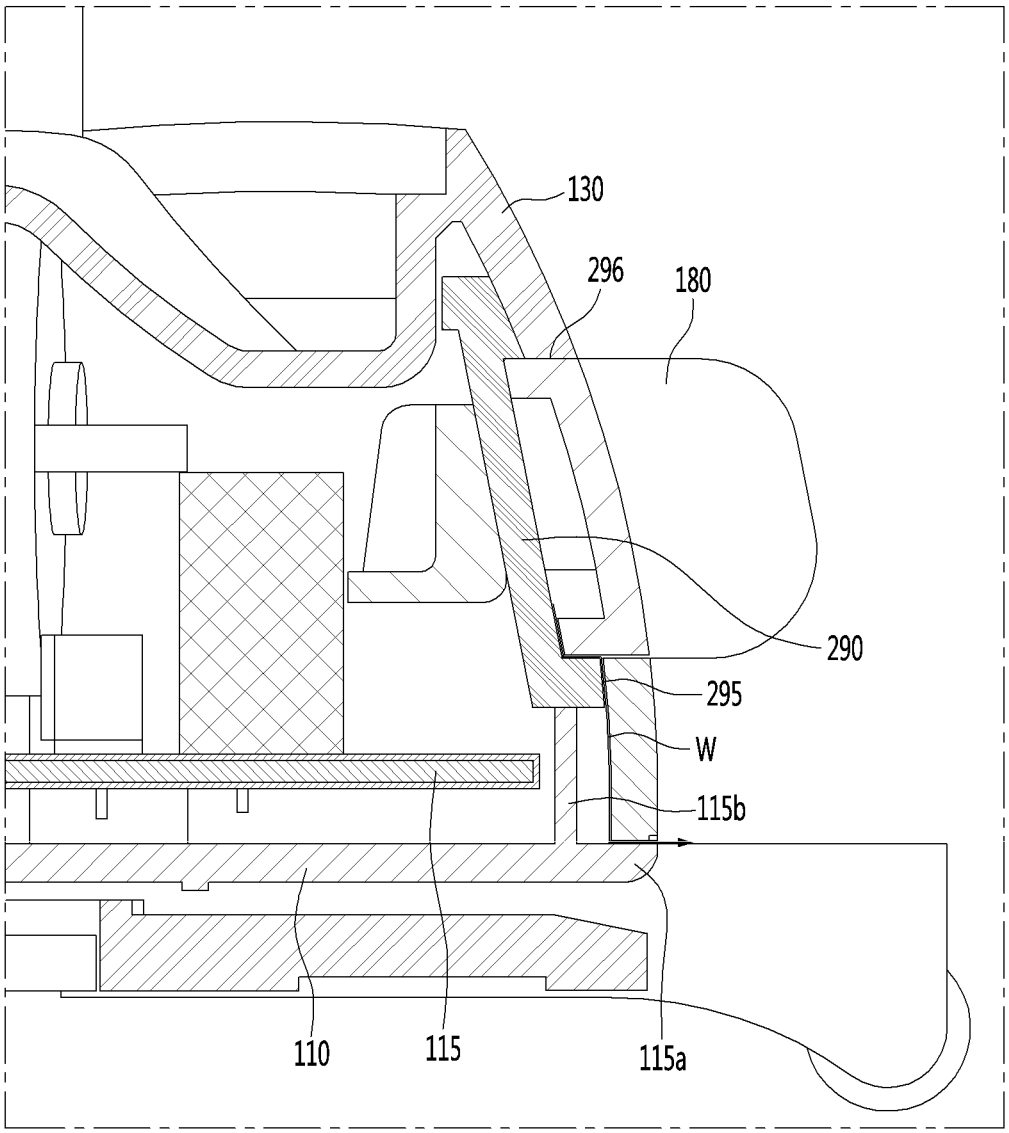
FIG. 17 is a sectional view taken along line D-D in FIG. 4.

FIG. 17 is a sectional view taken along line D-D in FIG. 4.

Referring to FIG. 17, the nozzle cover 130 may include an opening 296. Regulating unit 180 may extend through opening 296.

The nozzle cover 130 may include a supporting portion 290 configured to support the adjusting unit 180. The supporting unit 290 may slidably support the adjusting unit 180 passing through the opening 296.

The supporting portion 290 may be coupled to the nozzle cover 230 from the inside of the nozzle housing 100. A gap 295 may exist between the supporting portion 290 and the wall of the nozzle cover 130.

The water may flow into the nozzle housing 100 through the opening 296 when the water drops on a side of the regulating unit 180.

The water flowing into the nozzle housing 100 may flow through the gap 295 between the supporting portion 290 and the nozzle cover 130.

It may be necessary to prevent the water flowing through the gap 295 between the supporting portion 290 and the nozzle cover 130 from flowing to the control board 115.

In the disclosed exemplary embodiment, the nozzle base 110 may include an outer wall 115*b* configured to block water from flowing to the control board 115. The outer wall 115*b* may be provided at a position spaced inwardly from the end portion 115*a* of the nozzle base 110 and may extend along a portion of the circumference of the nozzle base 110.

The nozzle cover 130 may be seated on the nozzle base 110 and the outer wall 115*b* may be spaced apart from a wall of the nozzle cover 130 when the nozzle cover 130 is seated on the nozzle base 110. A gap 295 between the support portion 290 and the nozzle cover 130 may be positioned to face a portion between the outer wall 115*b* and the wall of the nozzle base 110. The outer wall 115*b* may be positioned between the control board 115 and the end portion 115*a* of the nozzle base 110. The upper-end portion of the outer wall 115*b* may be positioned higher than the upper surface of the control board 115.

The rotation centers C1 and C2 of the rotation cleaning units 40 and 41 may be positioned between the blocking rib 128 and the control board 115.

Therefore, even if the water from the outside falls into the nozzle base 110, water may not flow toward the control board 115 by the outer wall 115*b*, and may be discharged again to the outside through the space between the nozzle base 110 and the nozzle cover 130 (see arrow W).

<Driving Device>

Figure 18:
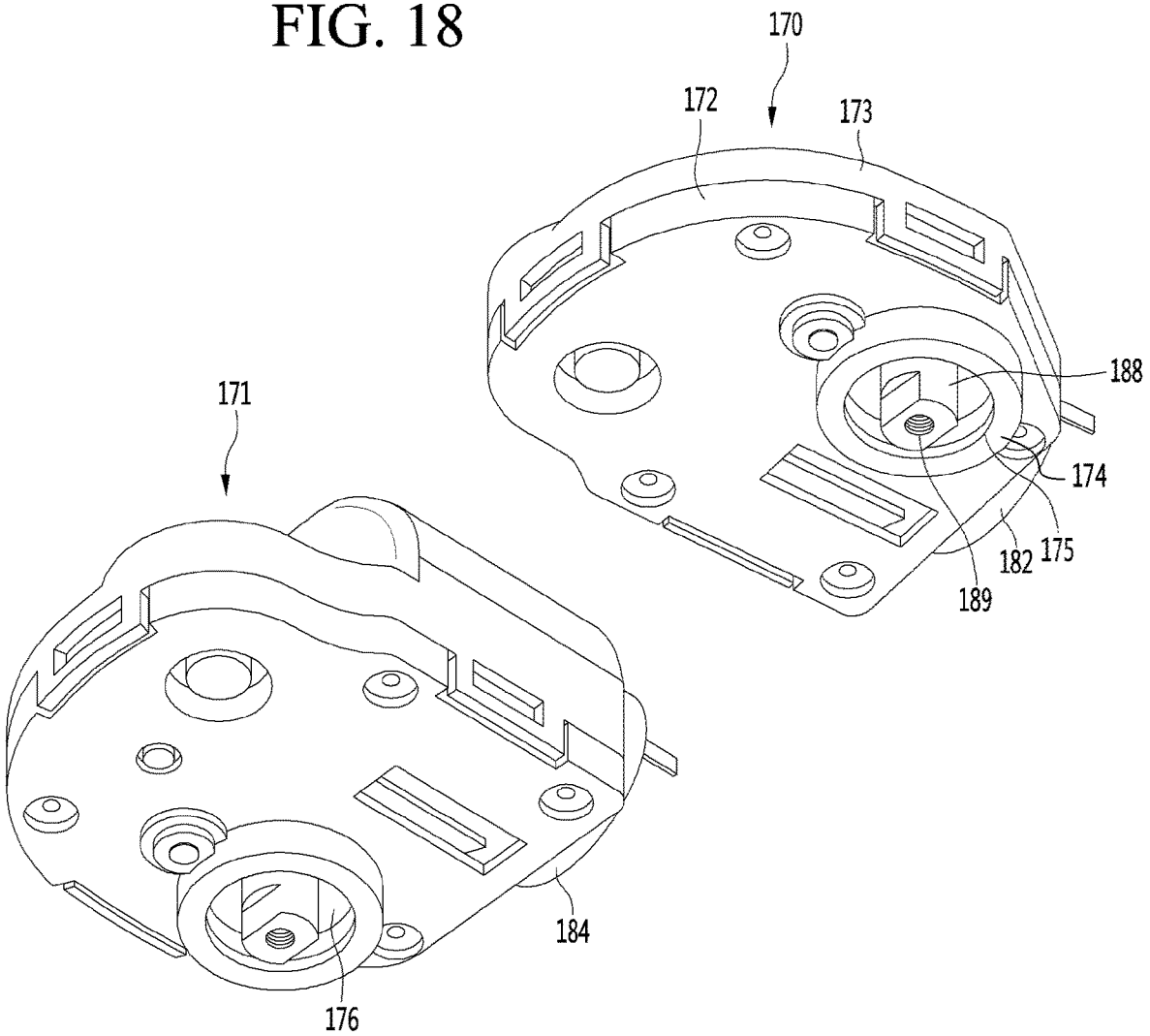
FIG. 18 is a perspective view illustrating first and second driving devices according to an exemplary embodiment of the present disclosure.

FIG. 18 is a view illustrating the first and second driving devices according to an exemplary embodiment of the present disclosure as viewed from below.

Referring to FIG. 18, the first driving device 170 and the second driving device 171 may be formed symmetrically in the lateral direction.

The first driving device 170 may include a first driving motor 182 and the second driving device 171 may include a second driving motor 184.

Each of the driving devices 170 and 171 may further include a motor housing. The driving motors 182 and 184 and a power transmission unit for transmitting power may be received in the motor housing.

The motor housing may include, for example, a first housing 172, and a second housing 173 coupled to the upper side of the first housing 172.

The axis of each of the driving motors 182 and 184 may extend in the horizontal direction when the driving motors 182 and 184 is installed in the motor housing.

The first housing 172 may have a shaft hole 175. The transmission shafts 188 for coupling with the rotation plates 420 or 440 of the power transmission unit may pass through the shaft hole 175.

The horizontal section of the transmission shaft 188 may be formed in a non-circular shape such that relative rotation of the transmission shaft 188 is prevented when the transmission shaft 180 is coupled with the rotation plates 420 or 440.

A sleeve 174 may be provided around the shaft hole 175 in the first housing 172. The sleeve 174 may protrude from the lower surfaces of the first housing 172. A bearing 176 to which the transmission shaft 188 is connected may be provided in a space defined by the sleeve 174.

<Rotation Plate>

Figure 19:
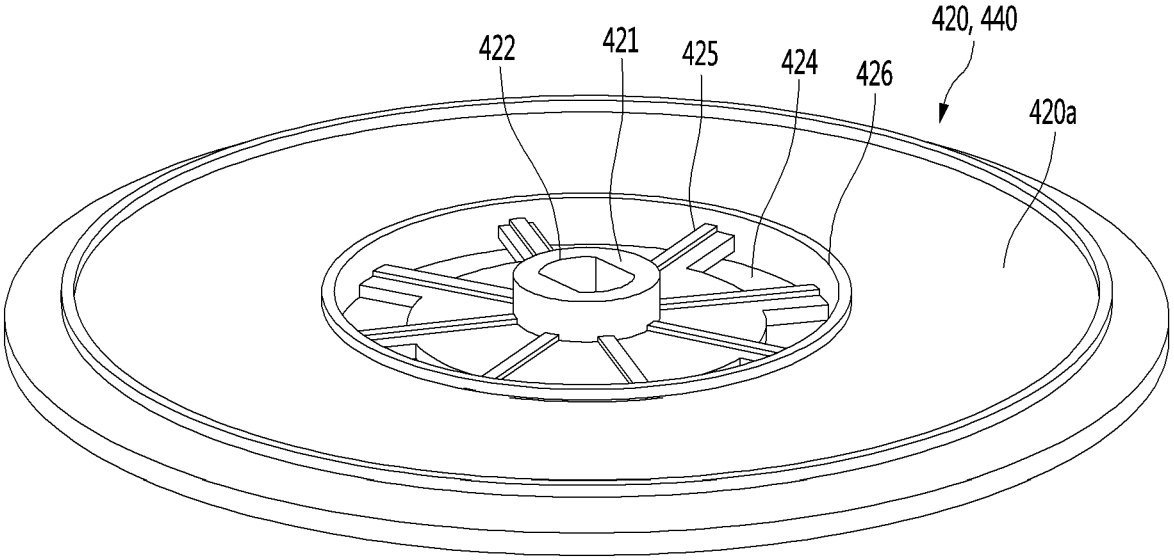
FIG. 19 is a top view illustrating a rotation plate according to an exemplary embodiment of the present disclosure.
Figure 20:
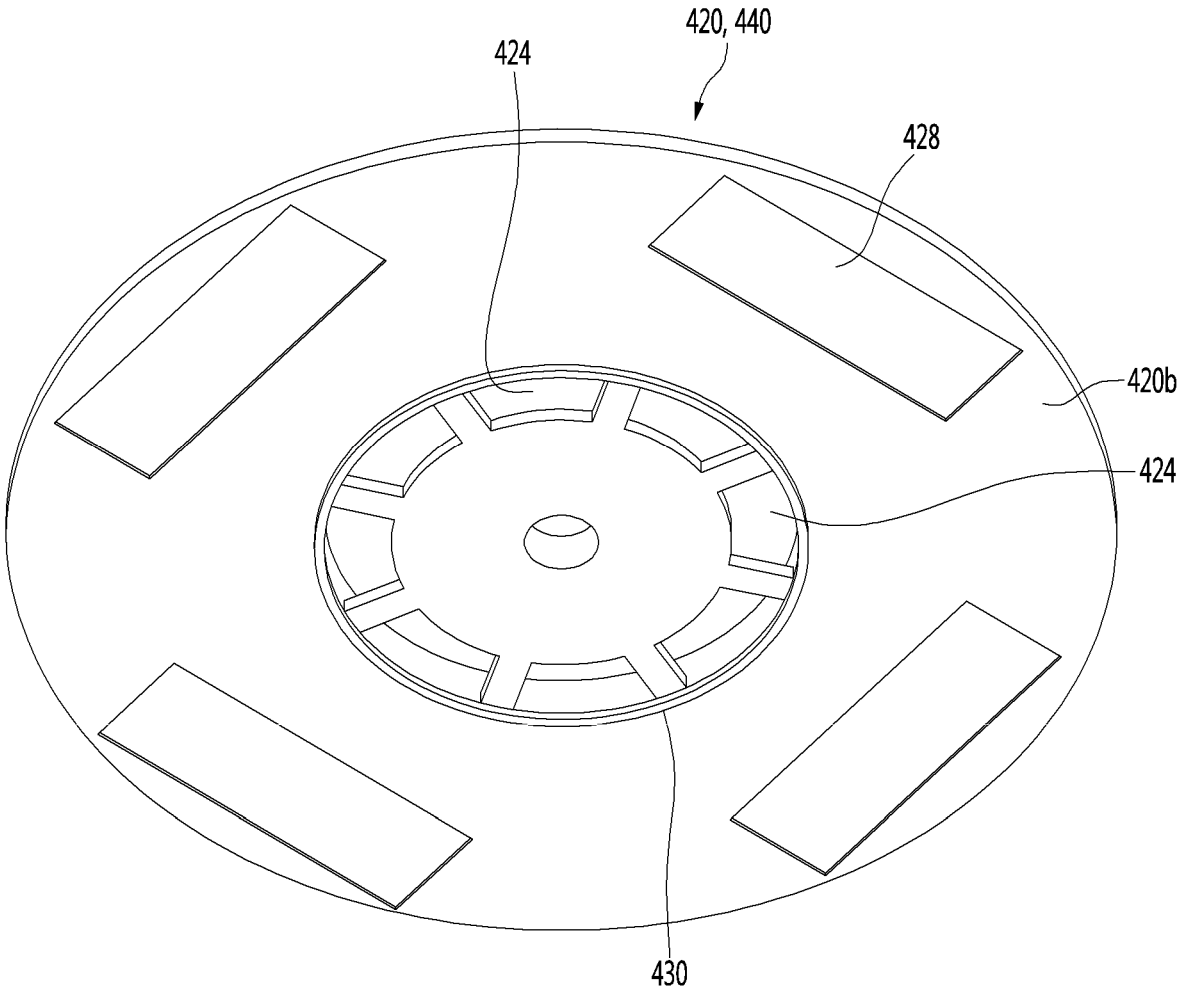
FIG. 20 is a bottom view illustrating the rotation plate according to an exemplary embodiment of the present disclosure.

FIG. 19 is a top view illustrating a rotation plate according to an exemplary embodiment of the present disclosure as viewed from above, and FIG. 20 is a bottom view illustrating a rotation plate according to an exemplary embodiment of the present disclosure as viewed from below.

Referring to FIG. 19 and FIG. 20, each of the rotation plates 420 and 440 may include a shaft coupling unit 421 configured to couple with the transmission shaft 188. The shaft coupling unit 421 may be provided at a central portion of each of the rotation plates 420 and 440.

For example, the transmission shaft 188 may be inserted into the shaft coupling unit 421. For this purpose, a shaft receiving groove 422 for inserting the transmission shaft 188 may be formed in the shaft coupling unit 421.

A fastening member may be drawn into the shaft coupling unit 421 from below the rotation plates 420 and 440 and be fastened to the transmission shaft 188 when the transmission shaft 188 is coupled to the shaft coupling unit 421.

The rotation plates 420 and 440 may include a plurality of water passage holes 424 disposed radially outwardly of the shaft coupling unit 421.

In the disclosed exemplary embodiment, since the rotation plates 420 and 440 are rotated when the mops 402 and 404 are attached to the lower sides of the rotation plates 420 and 440, the plurality of water passage holes 424 may be spaced circumferentially around the shaft coupling unit 421 to smoothly supply water to the mops 402 and 404 through the rotation plates 420 and 440.

The plurality of water passage holes 424 may be defined by a plurality of ribs 425. The ribs 425 may be positioned lower than the upper surface 420*a* of the rotation plates 420 and 440.

When the rotation plates 420 and 440 rotate, centrifugal force may act on the rotation plates 420 and 440. It may be necessary to prevent the water sprayed to the rotation plates 420 and 440 from flowing radially outward when the water may not be able to pass through the water passage holes 424 in the rotation plates 420 and 440 due to the centrifugal force.

Therefore, water blocking rib 426 may be formed on the upper surface 420*a* of the rotation plates 420 and 440 at a radially outer location relative to the water passage holes 424. The water blocking ribs 426 may be formed continuously in the circumferential direction. In other words, the plurality of water passage holes 424 may be positioned in the inner region of the water blocking ribs 426.

An installation groove 428 may be formed on the lower surface 420*b* of the rotation plates 420 and 440 to provide attachment means for attaching the mops 402 and 404. The attachment means may be, for example, a Velcro.

A plurality of installation grooves 428 may be spaced apart in the circumferential direction with respect to the rotation centers C1 and C2 of the rotation plates 420 and 440. Therefore, a plurality of attachment means may be provided on the lower surface 420*b* of the rotation plates 420 and 440.

In the disclosed exemplary embodiment, the installation groove 428 may be disposed radially outward of the water passage hole 424 with respect to the rotation centers C1 and C2 of the rotation plates 420 and 440.

For example, the water passage hole 424 and the installation groove 428 may be sequentially arranged radially outward from the rotation centers C1 and C2 of the rotation plates 420 and 440.

The lower surface 420*b* of the rotation plates 420 and 440 may be provided with a contact rib 430 which may contact the mop 402 or 404 when the mop 402 or 404 is attached to the attachment means.

The contact ribs 430 may protrude downward from a lower surface 420*b* of the rotation plates 420 and 440.

The contact ribs 430 may be disposed radially outward of the water passage holes 424 and may be formed continuously in the circumferential direction.

Since the mops 402 and 404 may be made of, for example, a fiber material and may deform, gaps may exist between the mops 402 and 404 and the lower surfaces 420*b* of the rotation plates 420 and 440 when the mops 402 and 404 are attached to the rotation plates 420 and 440 by the attaching means.

When the gaps between the mops 402 and 404 and the lower surfaces 420*b* of the rotation plates 420 and 440 are large, water may not be absorbed by the mops 402 and 404 when water passes through the water passage hole 424 and flows out through the gap between the lower surfaces 420*b* of the rotation plates 420 and 440 and the upper surface of the mops 402 and 404.

However, according to the disclosed exemplary embodiment, when the mops 402 and 404 are coupled to the rotation plates 420 and 440, the contact ribs 430 may be brought into contact with the mops 402 and 404. For example, when the nozzle 1 is placed on the floor, the contact rib 430 may press the mops 402, 404 due to the load exerted by the nozzle 1.

Accordingly, the contact ribs 430 may prevent the formation of the gap between the lower surfaces 420*b* of the rotation plates 420 and 440 and the upper surfaces of the mops 402 and 404. Thus, water passing through the water passage holes 424 may be smoothly supplied to the mops 402 and 404.

<Disposition of Driving Device>

Figure 21:
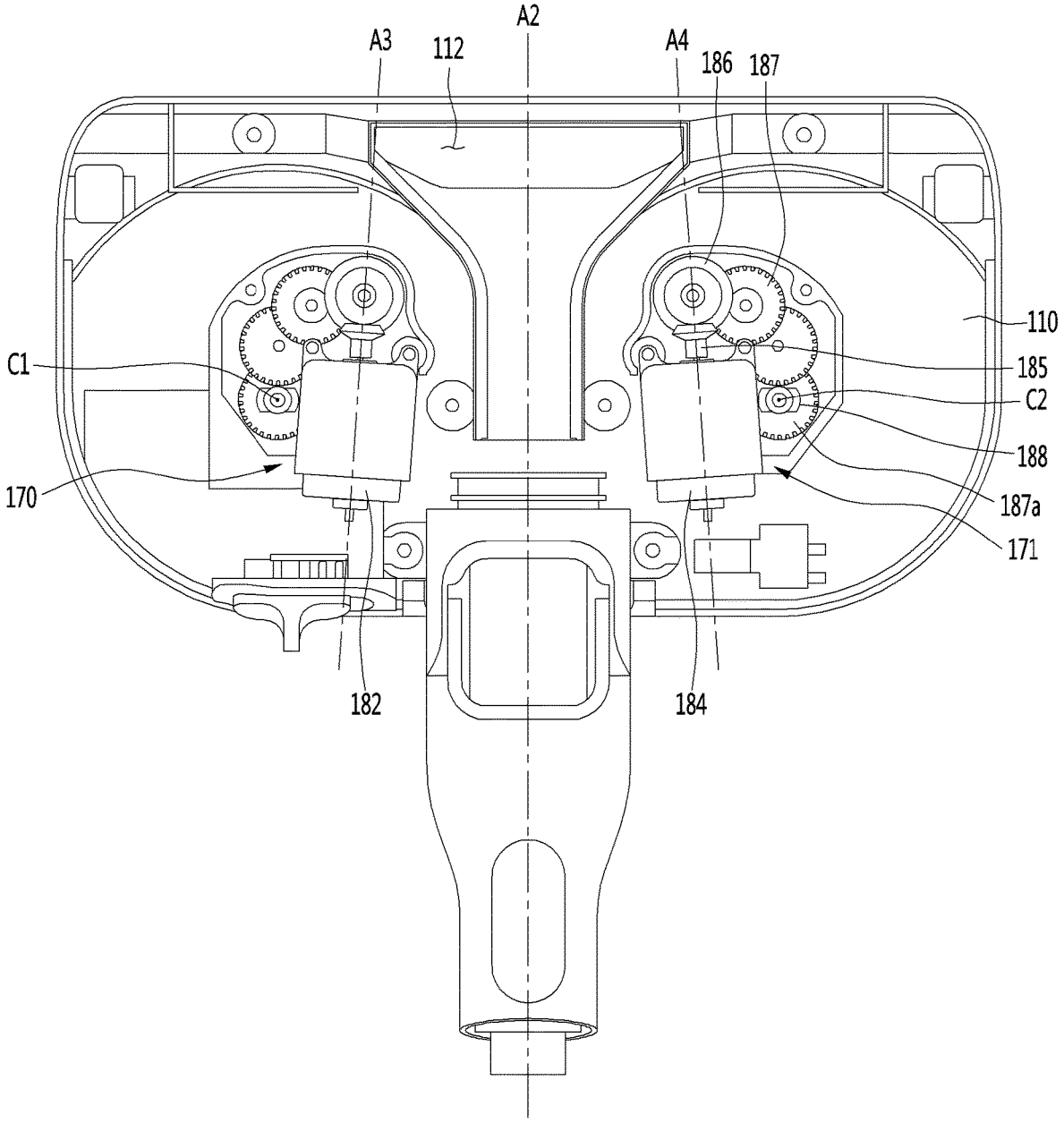
FIG. 21 is a plan view illustrating a state where a driving device is installed in a nozzle base according to an exemplary embodiment of the present disclosure.
Figure 22:
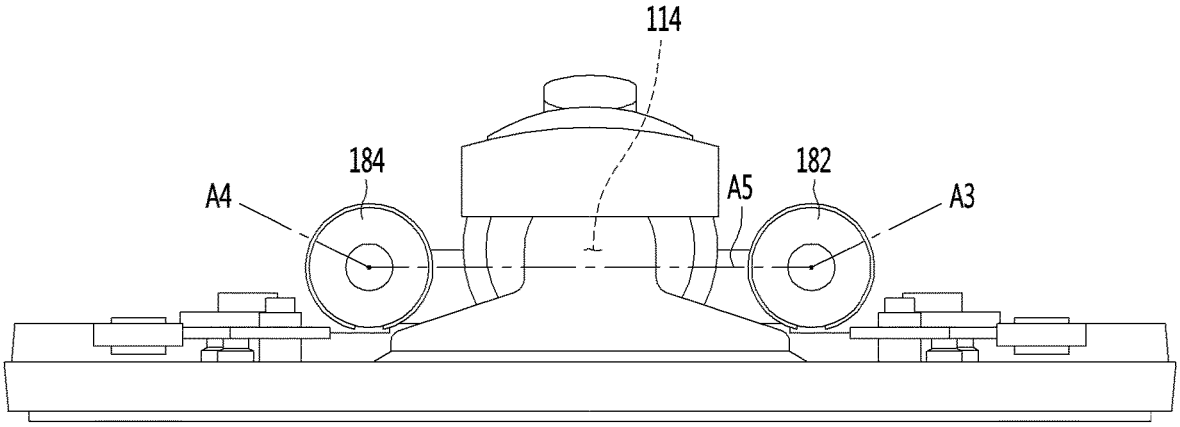
FIG. 22 is a front view illustrating a state where a driving device is installed in a nozzle base according to an embodiment of the present disclosure.

FIG. 21 is a plan view illustrating a driving device installed on a nozzle base according to an exemplary embodiment of the present disclosure, and FIG. 22 is a front view illustrating a driving device installed on a nozzle base according to an exemplary embodiment of the present disclosure.

Particularly, FIG. 21 illustrates a state where the second housing of the motor housing is removed.

Referring to FIG. 21 and FIG. 22, the driving devices 170 and 171 may be disposed or the nozzle base 110 so as to be spaced apart from each other in the lateral direction, as described above.

A centerline A2 of the second flow path 114 may be positioned between the first driving device 170 and the second driving device 171.

The axis A3 of the first driving motor 182 and the axis A4 of the second driving motor 184 may extend in the front and rear direction.

The axis A3 of the first driving motor 182 and the axis A4 of the second driving motor 184 may be parallel or may be disposed at a predetermined angle.

In the disclosed exemplary embodiment, the imaginary line A5 connecting the axis A3 of the first driving motor 182 and the axis A4 of the second driving motor 184 may pass through the second flow path 114. This is because each of the driving motors 182 and 184 is positioned close to the rear side of the nozzle 1 so that the increase in the height of the nozzle 1 by the driving motors 182 and 184 may be prevented.

The power transmission unit may include a driving gear 185 connected to the shafts of each of the driving motors 182 and 184 and a plurality of transmission gears 187 for transmitting the rotational force of the driving gear 185.

The axis of the driving motors 182 and 184 A3 and A4 may extend in the horizontal direction while the rotation centerline of the rotation plates 420 and 440 may extend in the vertical direction. Therefore, the driving gear 135 may be a spiral bevel gear, for example.

The transmission shaft 188 may be connected to a gear 187*a* among gears plurality of transmission gears.

In addition, when the driving gears 185 and 185 are connected to the shaft of each of the driving motors 182 and 184, the driving gear 185 may be positioned between the driving motors 182 and 184 and the first flow path 112 so that the increase in the height of the nozzle 1 due to the driving devices 170 and 171 may be minimized.

In this case, the increase in height of a side of the front end portion of the nozzle 1 may be minimized because the driving motors 182 and 184 having the longest vertical length of the driving devices 170 and 171 may be positioned as close as possible to the rear side in the nozzle main body 10.

In the disclosed exemplary embodiment, the rotation centers C1 and C2 of the rotation plates 420 and 440 may coincide with the rotation center of the transmission shaft 188.

The axes A3 and A4 of the driving motors 182 and 184 may be positioned in the region between the rotation centers C1 and C2 of the rotation plates 420 and 440.

In addition, the driving motors 182 and 184 may be positioned in a region between the rotation centers C1 and C2 of the rotation plates 420 and 440.

In addition, each of the driving motors 182 and 184 may be disposed so as to overlap with the imaginary line connecting the first rotation center C1 and the second rotation center C2 in the vertical direction.

<Water Supply Flow Path>

Figure 23:
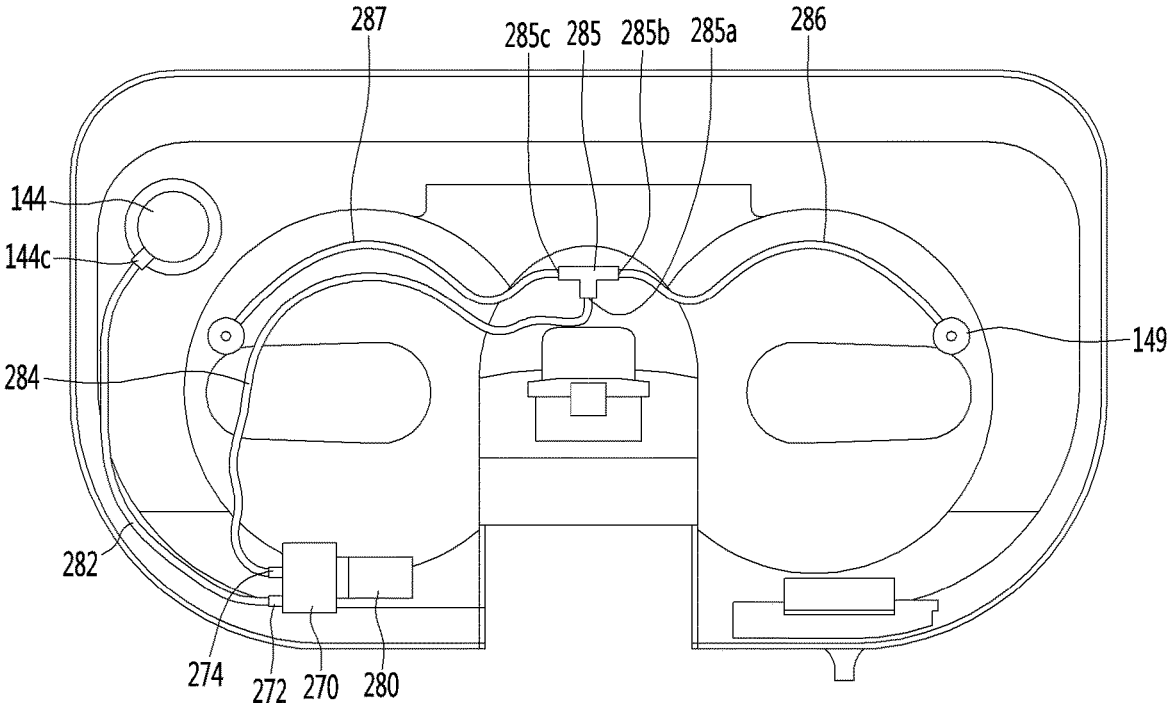
FIG. 23 is a view illustrating a water supply flow path for supplying water in a water tank to the rotation cleaning unit according to an exemplary embodiment of the present disclosure.
Figure 24:
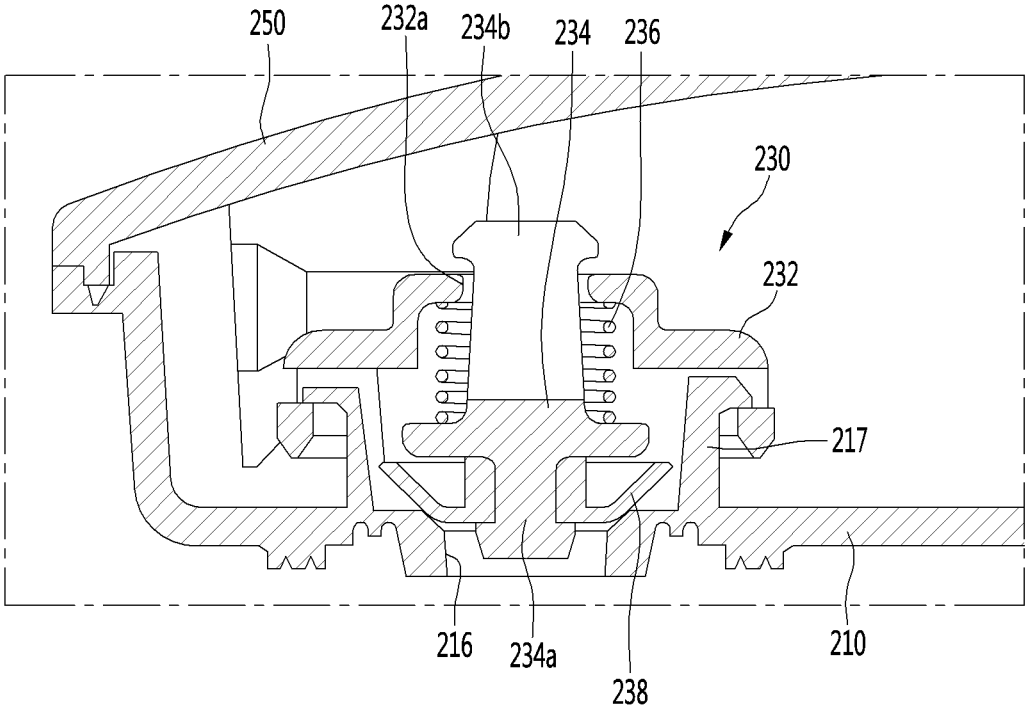
FIG. 24 is a view illustrating a valve in a water tank according to an exemplary embodiment of the present disclosure.
Figure 25:
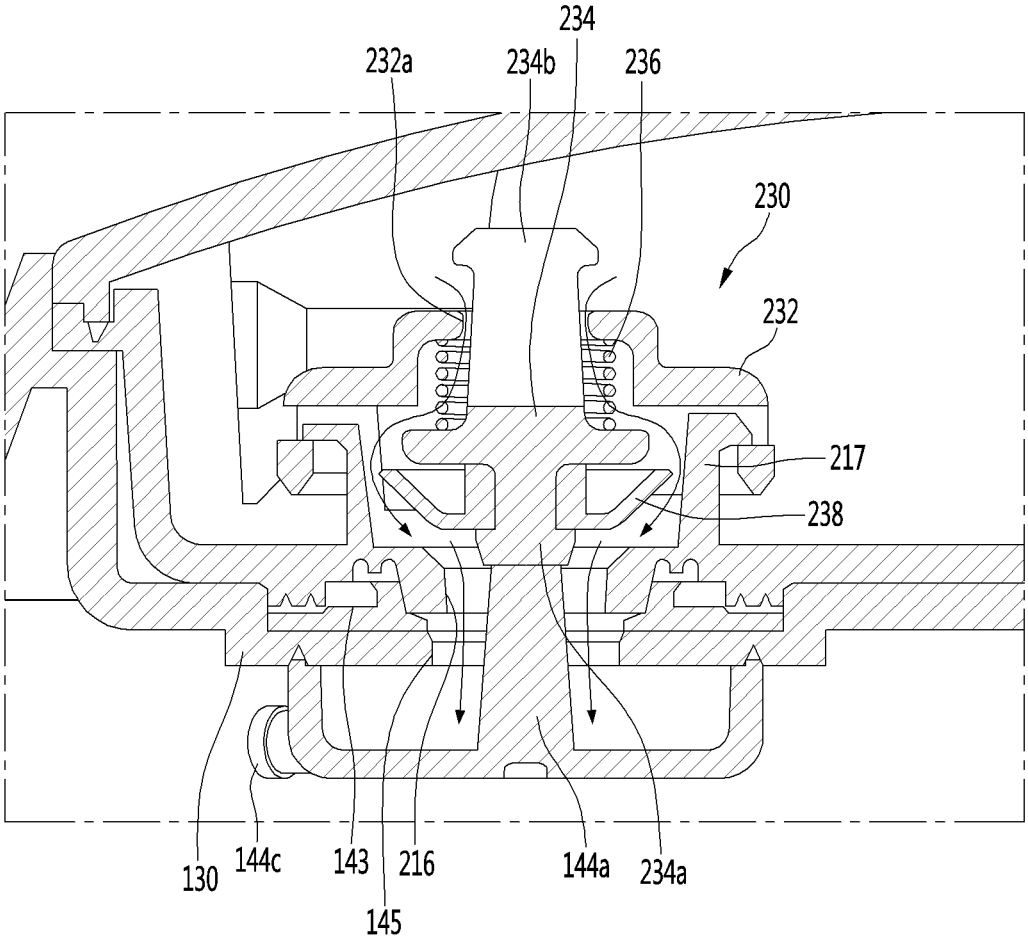
FIG. 25 is a view illustrating a state where the valve opens the discharge port in a state where the water tank is mounted to the nozzle housing.

FIG. 23 is a view illustrating a water supply flow path for supplying water of a water tank to the rotation cleaning unit according to an exemplary embodiment of the present disclosure, FIG. 24 is a view illustrating a valve in a water tank according to an exemplary embodiment of the present disclosure, and FIG. 25 is a view illustrating the valve opening the discharge port when the water tank is mounted on the nozzle housing.

Figure 26:
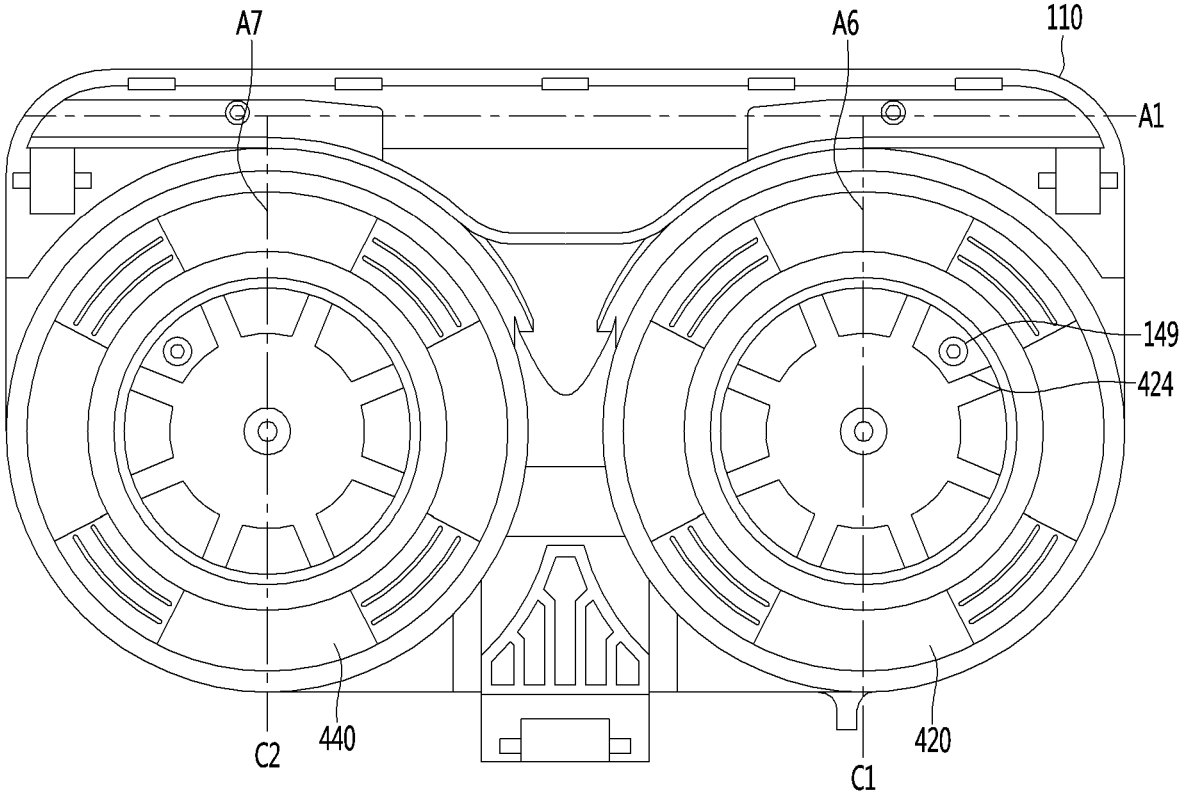
FIG. 26 is a view illustrating a state where a rotation plate according to an exemplary embodiment of the present disclosure is coupled to a nozzle body.
Figure 27:
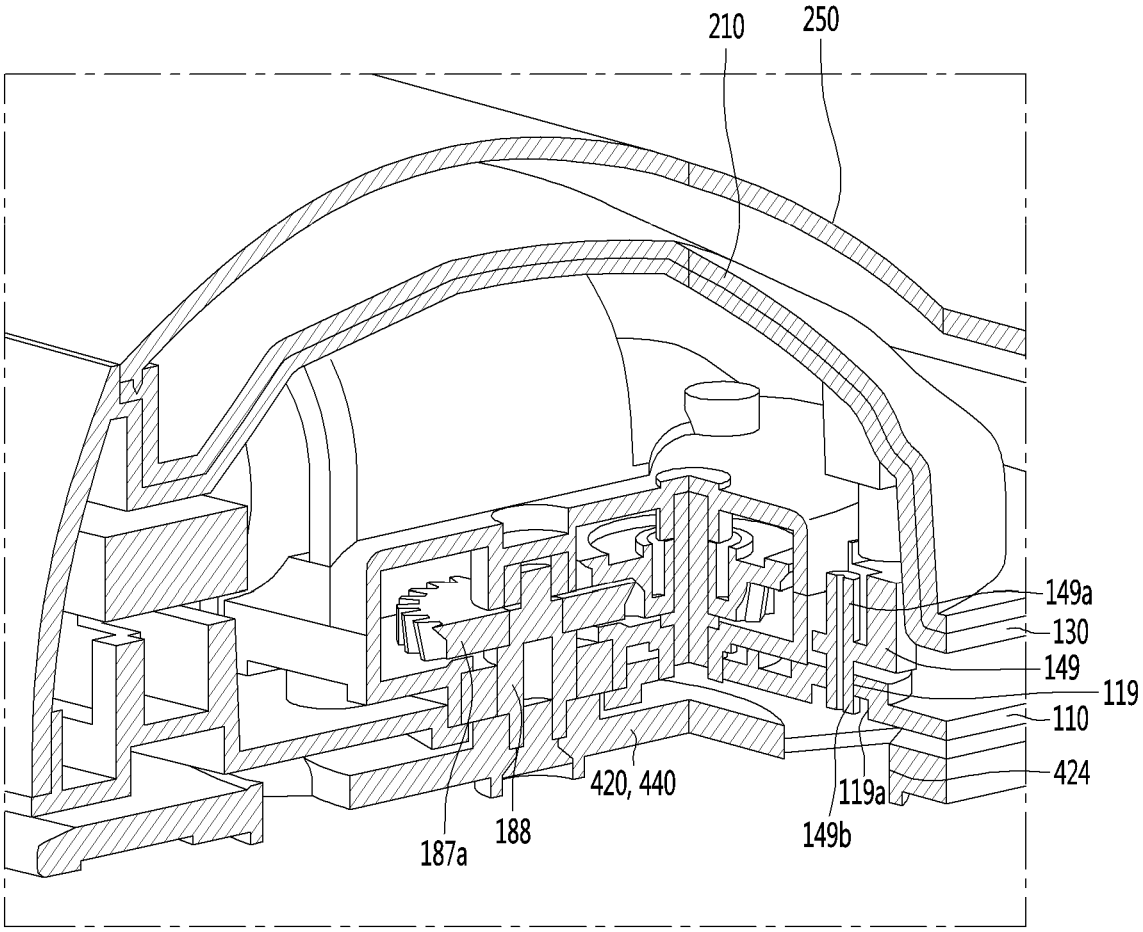
FIG. 27 is a view illustrating disposition of an injection nozzle in a nozzle main body according to an exemplary embodiment of the present disclosure.

FIG. 26 is a view illustrating a state where a rotation plate according to an embodiment of the present disclosure is coupled to a nozzle main body and FIG. 27 is a view illustrating a disposition of a spray nozzle in a nozzle main body according to an exemplary embodiment of the present disclosure.

Figure 28:
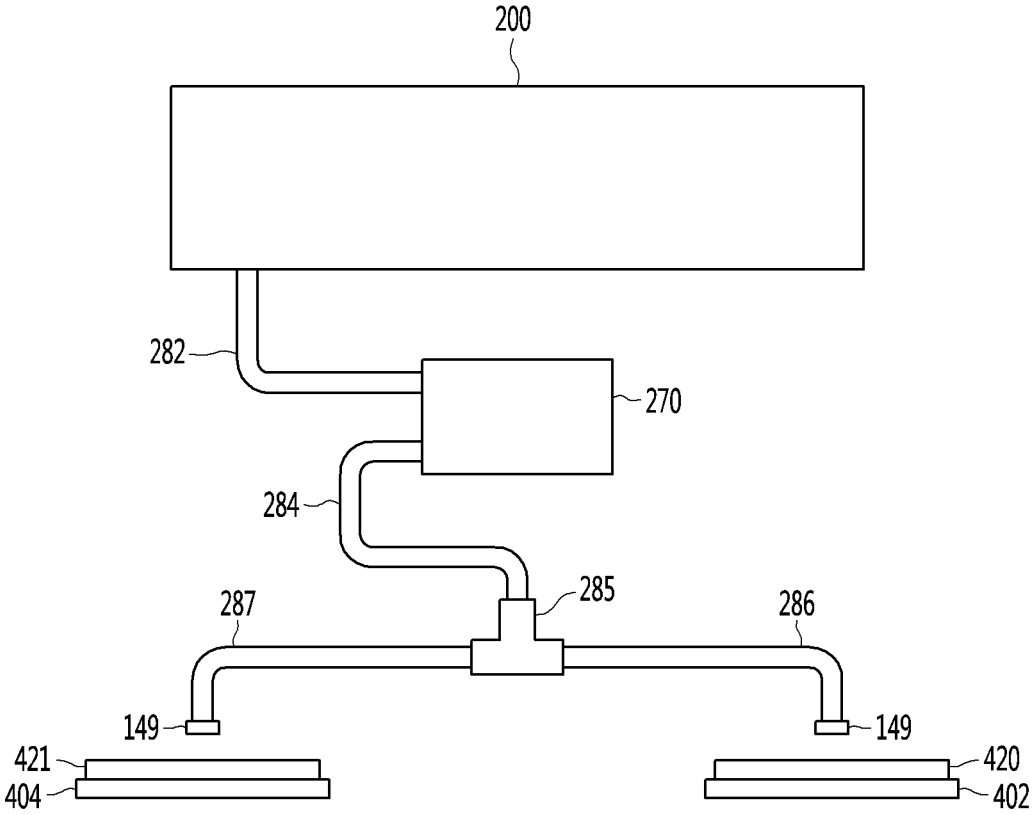
FIG. 28 is a conceptual diagram illustrating an exemplary process of supplying water to a rotation cleaning unit in a water tank according to an exemplary embodiment of the present disclosure.

FIG. 28 is a conceptual diagram illustrating a process or supplying water to a rotation cleaning unit in a water tank according to an exemplary embodiment of the present disclosure.

Referring to FIG. 23 to FIG. 28, the water supply flow path of the disclosed exemplary embodiment may include a first supply tube 282 connected to the valve operating unit 144, a water pump 270 connected to the first supply tube 282, and a second supply tube 284 connected to the water pump 270.

The water pump 270 may include a first connection port 272 to which the first supply tube 282 is connected and a second connection port 274 to which the second supply tube 284 is connected. The first connection port 272 may be an inlet, and the second connection port 274 may be a discharge port.

The water supply flow path may include a connector 285 to which the second supply tube 284 may be connected.

The connector 285 may be formed such that the first connection unit 285*a*, the second connection unit 285*b*, and the third connection unit 285*c* may be arranged in a T-shape. The second connection tube 284 may be connected to the first connection unit 285*a*.

The water supply flow path may include a first branch tube 286 connected to the second connection unit 285*b* and a second branch tube 287 connected to the third connection unit 285*b*.

Accordingly, the water flowing through the first branch tube 286 may be supplied to the first rotation cleaning unit 40 and the water flowing through the second branch tube 287 may be supplied to the second rotation cleaning unit 41.

The connector 285 may be positioned at the center portion of the nozzle main body 10 such that each of the branch tubes 286 and 287 has about the same length.

For example, the connector 285 may be positioned below the flow path cover 136 and above the flow path forming portion 150. Thus, substantially the same amount of water may be dispensed from the connector 285 to each of the branch tubes 286 and 287.

In the disclosed exemplary embodiment, the water pump 270 may be positioned at one point on the water supply flow path.

For example, the water pump 270 may be positioned between the valve operating unit 144 and the first connection unit 285*a* of the connector 285 so that water may be discharged from the water tank 200 using a minimum number of the water pumps 270.

In the disclosed exemplary embodiment, the water pump 270 may be installed in the nozzle cover 130 so that the water pump 270 may be positioned close to the portion where the valve operating unit 144 is installed.

As an example, the valve operating unit 144 and the water pump 270 may be provided on one side or both sides of the nozzle main body 10 with respect to the centerline A2 of the second flow path 114.

Therefore, the length of the first supply tube 282 may be reduced, and accordingly, the length of the water supply flow path may be reduced.

Each of the branch tubes 286 and 287 may be connected to the spray nozzles 149. The spray nozzle 149 may also form the water supply flow path of the present disclosure.

The spray nozzle 149 may include a connection unit 149*a* to be connected to each of the branch tubes 286 and 287 as described above.

The spray nozzle 149 may further include a nozzle end portion 149*b*. The nozzle end portion 149*b* may extend downward through the nozzle hole 119. In other words, the nozzle end portion 149*b* may be disposed on the outside of the nozzle housing 100.

When the nozzle end portion 149*b* is positioned outside the nozzle housing 100, water sprayed through the nozzle end portion 149*b* may be prevented from being drawn into the nozzle housing 100.

To prevent the nozzle end portion 149*b* from being exposed to the outside of the nozzle housing 100 and from being damaged, grooves 119*a* recessed upward may be formed in the bottom of the nozzle base 110. The nozzle end portion 149*b* may be positioned in the groove 119*a*. For example, the nozzle end portion 149*b* may pass through the nozzle hole 119. In other words, the nozzle hole 119 may be formed in the groove 119*a*.

The nozzle end portion 149*b* may be disposed to face the rotation plates 420 and 440 in the groove 119*a*.

Therefore, the water sprayed from the nozzle end portion 149*b* may pass through the water passage hole 424 of the rotation plates 420 and 440.

A line perpendicularly connecting the first rotation center C1 and the centerline A1 of the first flow path 112 may be referred to as a first connection line A6, and a line perpendicularly connecting the second rotation center C2 and an axis A1 of the first flow path 112 may be referred to as a second connecting line A7 (see FIG. 26).

The first connection line A6 and the second connection line A7 may be positioned in a region between a pair of spray nozzles 149 for supplying water to each of the rotation cleaning units 40 and 41.

This is because the spray nozzle 149 may be positioned to prevent interference with these parts, since the components constituting the driving devices 170 and 171 may exist in the area between the first connection line A6 and the second connection line A7.

In addition, the horizontal distance between the spray nozzle 149 and the centerline A1 of the first flow path 112 may be shorter than the horizontal distance between each of the rotation centers C1 and C2 and the centerline A1 of the first flow path 112.

The valve 230 may include a movable unit 234, an opening and closing unit 238, and a fixing unit 232.

The fixing unit 232 may be fixed to a fixing rib 217 protruding upward from the first body 210 of the water tank 200.

The movable unit 234 may pass through an opening 232*a* in the fixing unit 232.

The fixing unit 232 may restrict the movable unit 234 from moving upward at a predetermined height from the fixing unit 232 when the fixing unit 232 is coupled with the fixing rib 217.

The movable unit 234 may be movable in the vertical direction when a portion of the movable unit 234 passes through the opening 232*a*. When the movable unit 234 is moved upward, water may pass through the opening 232*a*.

The movable unit 234 may include a first extension portion 234*a* extending downward and coupled with the opening and closing unit 238 and a second extension portion 234*b* extending upwardly and passing through the opening 232*a*.

The movable unit 234 may be elastically supported by an elastic member 236. One end of the elastic member 236, as a coil spring, for example, may be supported by the fixed portion 232 and the other end may be supported by the movable unit 234.

The elastic member 236 may provide a force to the movable unit 234 to move the movable unit 234 downward.

The opening/closing unit 238 may selectively open the discharge port 216 by moving the movable unit 234 up and down.

At least a portion of the opening/closing unit 238 may have a diameter larger than the diameter of the discharge port 216 so that the opening/closing unit 238 may block the discharge port 216.

The opening/closing unit 230 may be formed of, for example, a rubber material so that the leakage of water is prevented when the opening/closing unit 238 blocks the discharge port 216.

The elastic force of the elastic member 236 may be applied to the movable unit 234 so that the opening and closing unit 238 may block the discharge port 216 unless an external force is applied to the movable unit 234.

The movable unit 234 may be moved by the valve operating unit 144 in the process of mounting the water tank 200 to the nozzle main body 10.

The valve operating unit 144 may be coupled to the nozzle cover 130 from below the nozzle cover 130 as described above. A water passage opening 145 through which the water discharged from the water tank 200 passes may be formed in the nozzle cover 100.

The valve operating unit 144 may include a pressing portion 144*a* passing through the water passage opening 145. The pressing portion 144*a* may protrude upward from the bottom of the nozzle cover 130 when extending through the water passage opening 145 of the nozzle cover 130.

The valve operating unit 144 may form a water supply flow path together with the bottom of the nozzle cover 130. A connection tube 144*c* for connecting the first supply tube 282 may be provided at one side of the valve operating unit 144.

The diameter of the water passage opening 145 may be larger than the outer diameter of the pressing portion 144*a* so that water may flow smoothly when the pressing portion 144*a* extends through the water passage opening 145.

When the water tank 200 is mounted on the nozzle main body 10, the pressing portion 144*a* may be drawn into the discharge port 216 of the water tank 200. The pressing portion 144*a* may press the movable unit 234 in a process in which the pressing portion 144*a* is being drawn into the discharge port 216 of the water tank 200.

The movable unit 234 may be lifted and the opening and closing unit 238 coupled to the movable unit 234 may move upward together with the movable unit 234 to be separated from the discharge port 216, thereby opening the discharge port 216.

The water in the water tank 200 may be discharged through the discharge port 216, may flow along the valve operating unit 144 through the water passage opening 145 and then may be supplied to the first supply tube 282 connected to the connection tube 144*c*.

The water supplied to the first supply tube 282 may flow into the second supply tube 284 after being drawn into the water pump 270. The water flowing into the second supply tube 284 may flow to the first branch tube 286 and the second branch tube 287 by the connector 285. The water flowing into each of the branch tubes 286 and 287 may be sprayed from the spray nozzle 149 toward the rotation cleaning units 40 and 41.

The water sprayed from the spray nozzle 149 may be supplied to the mops 402 and 404 after passing through the water passage holes 424 of the rotation plates 420 and 440. The mops 402 and 404 may be rotated while absorbing the supplied water to wipe the floor.

According to the disclosed exemplary embodiment, the cleaner may include a flow path which may suction foreign matters on the floor and may also wipe the floor using the mops attached to the rotation plates, thereby improving floor cleaning performance.

In addition, the water tank may be mounted on the nozzle, and water may be supplied to the mop, thereby increasing convenience for the user.

In addition, since the flow path may extend in the front and rear direction at the center of the nozzle and the driving device for rotating each of the rotation cleaning units may be disposed on opposite sides of the flow path, the length of the air flow path for flowing the air may be prevented from increasing, and thus the increase in flow path loss may be prevented.

Further, according to the disclosed exemplary embodiment, as the plurality of rotation members to which the mop is attached may be independently driven by the plurality of motors, there is an advantage that even if one of the plurality of motors fails, the cleaning may be performed by the other motor.

Further, since the water tank may be disposed so as to surround the driving unit cover which covers the driving device, the amount of water which may be stored in the water tank can be increased and the height of the entire nozzle may be prevented from increasing.

In addition, even if water leaks from the water tank or drops from the outside into the nozzle housing, the waterproof performance of the control board is improved because a drain hole may be formed in the nozzle base and a blocking rib which blocks water from flowing to the control board is provided.

In addition, according to the present disclosure, even if water introduces from the outside through the opening through which the adjusting unit passes, since an outer wall for blocking water may exist in the nozzle base, water may not flow to the control board and can be discharged again to the outside, and thus the waterproof performance of the control board is improved.

In addition, a flow path capable of suctioning foreign matters on the floor surface is provided and the floor surface can be cleaned by rotating the rotation plate with the mop attached thereto, thereby improving floor cleaning performance.

What is claimed is:

1. A nozzle for a cleaner comprising:

a nozzle housing including a nozzle base and a nozzle cover coupled to an upper side of the nozzle base a rotary cleaning unit rotatably disposed below the nozzle base and including a plurality of rotation plates spaced apart from each other in a lateral direction of the nozzle housing, the plurality of rotation plates being configured to be attached to a mop;

a suction flow path disposed between a front end of the nozzle housing and at least a portion of the rotary cleaning unit;

a driving unit provided in the nozzle housing and including a driving motor for driving the plurality of rotation plates;

a water tank detachably mounted on the nozzle cover;

a water supply flow path provided in the nozzle housing and configured to supply water stored in the water tank to the plurality of rotation plates;

a rib insertion hole formed in a front of the nozzle cover; and a blocking rib protruding upward from the nozzle base and disposed behind the rib insertion hole.

2. The nozzle of claim 1, wherein the water tank includes a coupling rib inserted into the rib insertion hole.

3. The nozzle of claim 2, wherein the rib insertion hole forms a recessed space to insert the coupling rib into the nozzle cover.

4. The nozzle of claim 3, wherein the coupling rib has a shape corresponding to the rib insertion hole and is disposed at a front end of the water tank.

5. The nozzle of claim 4, wherein the coupling rib is formed to protrude from the front end of the water tank.

6. The nozzle of claim 5, wherein the coupling rib is formed to fit into the rib insertion hole.

7. The nozzle of claim 2, wherein the rib insertion hole and the coupling rib are provided in plurality to correspond to each other.

8. The nozzle of claim 7, wherein:

the plurality of rib insertion holes are arranged to be spaced apart in the lateral direction, and the plurality of coupling ribs are spaced apart from each other in the lateral direction to correspond to the arrangement of the plurality of rib insertion holes.

9. The nozzle of claim 1, wherein at least a portion of the rib insertion hole is disposed above the blocking rib.

10. The nozzle of claim 9, wherein the blocking rib extends to contact a lower surface of the nozzle cover or extends to a portion adjacent to the lower surface of the nozzle cover.

11. The nozzle of claim 10, wherein the blocking rib is provided in plurality to correspond to the rib insertion hole.

12. The nozzle of claim 9, wherein the nozzle cover has a seating surface on which the water tank is seated, and wherein the rib insertion hole is formed to penetrate from the seating surface toward the nozzle base.

13. The nozzle of claim 12, wherein the seating surface of the nozzle cover forms a recessed space accommodating at least a portion of the water tank.

14. The nozzle of claim 12, wherein, in a state where the water tank is mounted on the nozzle cover, a valve for supplying water from the water tank to a water pump is fixed to the seating surface of the nozzle cover.

15. The nozzle of claim 14, wherein the valve is disposed behind the rib insertion hole.

16. The nozzle of claim 14, wherein a sealer is disposed on the seating surface to prevent leakage from a vicinity of the valve.

17. The nozzle of claim 16, wherein the rib insertion hole is formed to be spaced upward from the seating surface.

18. The nozzle of claim 1, wherein a control board for controlling the driving unit is disposed on a rear portion of the nozzle base.

19. The nozzle of claim 18, wherein the control board extends to have a curve along a rear inner circumferential surface of the nozzle base.

20. The nozzle of claim 19, wherein at least a portion of the control board is disposed behind the driving motor.

21. The nozzle of claim 18, wherein a distance between the blocking rib and the control board is closer than a distance between the rib insertion hole and the control board.

22. The nozzle of claim 19, wherein a distance between the blocking rib and the rib insertion hole is closer than a distance between the blocking rib and the control board.

23. The nozzle of claim 18, wherein the nozzle base includes a support protrusion for supporting the control board away from a bottom of the nozzle base.

24. The nozzle of claim 1, wherein suction flow path includes:

a first suction flow path formed along at least a portion of a front end of the nozzle base; and a second suction flow path extending in a front-rear direction from the first suction flow path.

25. The nozzle of claim 24, wherein the blocking rib and the rib insertion hole are provided as a pair symmetrically disposed about the second suction flow path, respectively.

26. The nozzle of claim 24, wherein a control board for controlling the driving unit is disposed on a rear portion of the nozzle base, and the control board is disposed on one side based on the second suction flow path.

27. The nozzle of claim 26, wherein a water pump provided on the water supply flow path is disposed on the opposite side to the control board with respect to the second suction flow path.

28. The nozzle of claim 1, wherein the nozzle base includes a drain hole for discharging the water introduced into the nozzle housing to the outside, and wherein the drain hole is positioned to overlap the plurality of rotation plates in a vertical direction.

* * * * *